US006146822A

United States Patent [19]

Asanuma et al.

[11] Patent Number: 6,146,822

[45] Date of Patent: Nov. 14, 2000

[54] THERMOGRAPHIC OR PHOTOTHERMOGRAPHIC IMAGE RECORDING ELEMENTS

[75] Inventors: Naoki Asanuma; Tatsuya Ishizaka; Hisashi Okamura, all of Kanagawa, Japan

[73] Assignee: Fuji Photo Film Co., Ltd., Kanagawa, Japan

[21] Appl. No.: 09/090,903

[22] Filed: Jun. 5, 1998

[30] Foreign Application Priority Data

| | | | |
|---|---|---|---|
| Jun. 6, 1997 | [JP] | Japan | 9-149249 |
| Jun. 6, 1997 | [JP] | Japan | 9-164990 |
| Jun. 6, 1997 | [JP] | Japan | 9-164992 |

[51] Int. Cl.[7] ..... G03C 1/498

[52] U.S. Cl. ..... 430/619; 430/531; 430/600; 430/613; 430/965

[58] Field of Search ..... 430/619, 617, 430/965, 600, 613, 531

[56] References Cited

U.S. PATENT DOCUMENTS

| | | | |
|---|---|---|---|
| 3,080,254 | 3/1963 | Grant, Jr. . | |
| 3,446,648 | 5/1969 | Workman . | |
| 3,782,941 | 1/1974 | Hartman et al. . | |
| 3,994,732 | 11/1976 | Winslow . | |
| 4,123,282 | 10/1978 | Winslow . | |
| 4,510,236 | 4/1985 | Gutman . | |
| 4,585,734 | 4/1986 | Weigel | 430/619 |
| 4,857,439 | 8/1989 | Dedio et al. | 430/619 |
| 5,028,523 | 7/1991 | Skoug | 430/617 |
| 5,656,419 | 8/1997 | Toya et al. | 430/619 |

FOREIGN PATENT DOCUMENTS

| | | |
|---|---|---|
| 54-87213 | 7/1979 | Japan . |
| 54-156523 | 12/1979 | Japan . |
| 54-156527 | 12/1979 | Japan . |

OTHER PUBLICATIONS

The Condensed Chemical Dictionary, Tenth Edition, Revised by Gessner G. Hawley. No Month, 1981.

*Primary Examiner*—Thorl Chea

*Attorney, Agent, or Firm*—Birch. Stewart, Kolasch & Birch, LLP

[57] ABSTRACT

Thermographic or photothermographic image recording elements comprising (a) a reducible silver salt, (b) a reducing agent, (c) a binder, (d) a specific phthalazine derivative and (e) an organic acid compound experience a minimized drop of image density when stored under warm humid conditions.

17 Claims, No Drawings

THERMOGRAPHIC OR PHOTOTHERMOGRAPHIC IMAGE RECORDING ELEMENTS

This invention relates to image recording elements including photothermographic elements containing a silver halide as a photocatalyst and thermographic elements merely utilizing a thermal reaction, and more particularly, to photothermographic image recording elements having improved storage stability prior to processing for image formation as well as improved image stability after image formation.

RELATED ART

Photothermographic materials which are processed by a thermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), and a reducing agent, typically dispersed in an (organic) binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

These photothermographic elements tend to fog during raw storage, heat development, and image storage because all the additives necessary to form silver images are contained in the photosensitive elements. It is almost requisite to add fog restraining additives.

In such photothermographic elements, additives known as "toners" are optionally contained for improving the density of silver images (image density), the tone of silver, and heat developability.

For photothermographic elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-drhazaoctane)-bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinrone derivatives or metal salts, or derivatives such as 4-(1-naphthyl)-phthalazinone, 6-chlorophthalazinone, 5,7-dimethoxyphthalazinone and 2,3-dihydro-1,4-phthalazinecione; combinations of phthalazinones with phthalic acid derivatives (e.g., phthalic acid, 4-methylphthalic acid, 4-nitrophthalic acid and tetrachlorophthalic anhydride); phthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6--dimercapto-1H, 4H-2,3a,5,6a-tetraazapentalene.

As for these toners, more appropriate arnrad more effective ones have been sought and developed from the standpoints of a compromise between the functions required as toners (e.g., image density, silver tone rand heat development improvement) and the disadvantages (e.g., volatilizing off the photosensitive material), and a combination with other coexisting additives such as antifoggants (so as to eliminate side effect or detrimental effect). Of these, phthalazine and combinations of phthalazine with phthalic acid derivatives are known effective.

However, even photothermographic elements using phthalazine as the toner suffer from the problem that the image density becomes substantially low if they are exposed and heat developed after storage under warm humid conditions.

Photothermographic elements using phthalazine and phthalic acid derivatives as the toner also have problems to be improved. (1) The image density is extremely low when they are exposed and heat developed after storage under forced raw storage conditions (especially underarm warm humid conditions). (2) Unexposed areas of images formed by heat development yield brown fog when stored under conditions that light and heat are concurrently applied.

Further problems of photothermographic elements are that photographic properties largely vary with developing temperatures and that development often causes fog. To solve these problems, a variety of antifoggants have been developed. Exemplary known antifoggants include thiosulfonic acid derivatives, sulfinic acid derivatives, mercury compounds, N-halogeno compounds, lithium salts, peroxides, persulfates, rhodium salts, cobalt salts, palladium salts, cerium salts, disulfide compounds, polyacids, and polyhalides. These are described in JP-A 10724/1974, 90118/1974, 97613/1974, 101019/1975, 116024/1975, 119624/1975, 120328/1975, 123331/1975, 134421/1975, 22431/1976, 42529/1976, 47419/1976, 51323/1976, 78227/1976, 121332/1976, 58022/1979, 70543/1981, 99335/1981, 90842/1984, 129642/1986, 129845/1987, 208191/1994, 2781/1995, 5621/1995, and 15809/1996, U.S. Pat. Nos. 3,589,903, 3,885,968, 5,340,712, 5,369,000, and 5,464,737.

Of the known antifogging techniques, it is most effective to use mercury compounds as the antifoggant. The use of mercury compounds as the antifoggant in photosensitive materials is disclosed, for example, in U.S. Pat. No. 3,589,903. The use of mercury compounds, however, is ecologically undesirable and it is desired to develop non-mercury base antifoggants. The above-exemplified compounds have been investigated as non-mercury base antifoggants. It is known that polyhalides are effective for preventing fog as disclosed in U.S. Pat. Nos. 3,874,946, 4,756,999, 5,340,712, EP 605981A1, 622666A1, 631176A1, JP-B 165/1979, and JP-A 2781/1995.

It is thus desired to have a technique capable of suppressing fog, achieving excellent photographic performance, and minimizing the lowering of photographic properties and the deterioration of images during storage.

SUMMARY OF THE INVENTION

An object of the invention is to provide an image recording element experiencing a minimized drop of image density during storage under warm humid conditions.

Another object of the invention is to provide an image recording element, especially a photothermographic element, which experiences a minimized drop of image density during forced raw storage and is improved in image retention under light/heat applied conditions.

A further object of the invention is to provide an image recording element which can form images with less fog, and has improved stability upon storage both before and after image formation in that neither a drop of the maximum density nor a rise of the minimum density may occur.

The invention provides a thermographic or photothermographic image recording element comprising (a) a reducible silver salt, (b) a reducing agent, (c) a binder, (d) a compound of the general formula (I), and (e) a compound of the general formula (II).

(I)

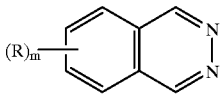

In formula (I), R represents a monovalent substituent and m is an integer of 1 to 4, with the proviso that when m≧2, a plurality of R groups may be the same or different, and when a plurality of R groups are close to each other, they may form an aliphatic, aromatic or heterocyclic ring.

(II)

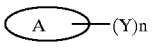

In formula (II), A represents an n-valent monocyclic or fused ring aromatic ring group, Y represents —COOH, —$SO_2H$ or —$SO_3H$, and n is equal to 1 or 2.

The image recording element may further contain a photosensitive silver halide as a photocatalyst.

Preferably, the compound of formula (I) is a compound of the general formula (I-a):

(I-a)

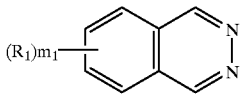

wherein $R_1$ is an alkyl, aryl, alkoxy, aryloxy, halogen, cyano or nitro group, and $m_1$ is an integer of 1 to 4, with the proviso that when $m_1 \geqq 2$, a plurality of $R_1$ groups may be the same or different, and when a plurality of $R_1$ groups are close to each other, they may form an aliphatic, aromatic or heterocyclic ring.

Preferably, the compound of formula (II) is a compound of the general formula (II-a):

(II-a)

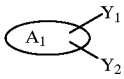

wherein $A_1$ is a phenylene or naphthylene group, each of $Y_1$ and $Y_2$ is —COOH, —$SO_2H$ or —$SO_3H$, and $Y_1$ and $Y_2$ are attached to $A_1$ in the ortho or meta relationship.

More preferably, the organic acid compound of formula (II-a) is a compound of the general formula (II-b):

(II-b)

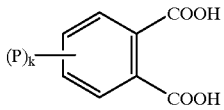

wherein P is an alkyl, aryl, alkoxy or nitro group, k is an integer of 1 to 4, with the proviso that when k≧2, a plurality of P groups may be the same or different.

The image recording element may further contain a compound of the general formula (III).

(III)

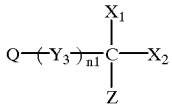

In formula (III), Q is an alkyl, aryl or heterocyclic group, $X_1$ and $X_2$ are halogen atoms, Z is a hydrogen atom or electron attractive group, $Y_3$ is —C(=O)—, —SO— or —$SO_2$—, and n1 is equal to 0 or 1.

In all the embodiments of the invention, the binder is preferably comprised of a polymer latex, and the compound of formula (I) is preferably added as a solid particle dispersion.

DETAILED DESCRIPTION OF THE INVENTION

The thermographic or photothermographic image recording element of the invention contains a reducible silver salt, a reducing agent, a binder, and preferably a photosensitive silver halide as a photocatalyst. It further contains a phthalazine derivative of the general formula (I) and an aromatic organic acid compound of the general formula (II).

The inclusion of the compounds of formulae (I) and (II) ensures that the image recording element has a high image density, experiences a minimized drop of image density during raw storage and is improved in image retention stability. If phthalazine is used instead of the phthalazine derivative of formula (I), then the image density after storage becomes low and the image retention stability becomes poor. If the compound of formula (II) is omitted and only the compound of formula (I) is contained, then no sufficient image density is obtained.

In the preferred embodiment, the image recording element is a thermographic (or heat-sensitive) recording element comprising a non-photosensitive organic silver salt, a reducing agent for the organic silver salt, and a binder. Alternatively, the image recording element is a photothermographic (or heat-developable photosensitive) recording element comprising a photosensitive silver halide, a binder, a non-photosensitive organic silver salt and a reducing agent for the organic silver salt. In either case, the element further contains a phthalazine derivative of the general formula (I), an aromatic organic acid compound of the general formula (II), and a polyhalide compound of the general formula (III).

The inclusion of the compounds of formulae (I) and (III) ensures that the image recording element have low fog, improved photographic properties, little or no losses of photographic properties during storage, and improved image retention stability. If phthalazine is used instead of the phthalazine derivative of formula (I), then substantial losses of photographic properties occur after storage and the image retention stability becomes poor. If the polyhalide compound of formula (III) is omitted and only the compound of formula (I) is contained, then there result poor photographic properties, increased fog, low sensitivity and poor image retention stability. The advantages of the invention are achieved by the combined used of the compound of formula (I) and the compound of formula (III).

FORMULA (I)

The compounds of the general formula (I) are described in detail.

(I)

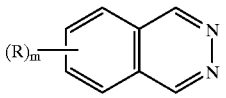

In formula (I), R is a monovalent substituent.

Examples of the substituents represented by R include alkyl groups, preferably having 1 to 20 carbon atoms, more preferably 1 to 12 carbon atoms, most preferably 1 to 8 carbon atoms, such as methyl, ethyl, n-propyl, iso-propyl, n-butyl, iso-butyl, tert-butyl, n-octyl, n-decyl, n-hexadecyl, cyclopropyl, cyclopentyl, and cyclohexyl; alkenyl groups, preferably having 2 to 20 carbon atoms, more preferably 2 to 12 carbon atoms, most preferaoly 2 to 8 carbon atoms, such as vinyl, allyl, 2-butenyl, and 3-pentenyl; alkynyl groups, preferably having 2 to 20 carbon atoms, more preferably 2 to 12 carbon atoms, most preferably 2 to 8 carbon atoms, such as propargyl and 3-pentynyl; aryl groups, preferably having 6 to 30 carbon atoms, more preferably 6 to 20 carbon atoms, most preferably 6 to 12 carbon atoms, such as phenyl, p-methylphenyl, and naphthyl; amino groups, preferably having 0 to 20 carbon atoms, more preferably 0 to 10 carbon atoms, most preferably 0 to 6 carbon atoms, such as amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, such as methoxy, ethoxy, and butoxy; aryloxy groups, preferably having 6 to 20 carbon atoms, more preferably 6 to 16 carbon atoms, most preferably 6 to 12 carbon atoms, such as phernrayloxy and 2-naphthyloxy; acyl groups, preferably having 1 to 20 carbon atoms, more preferably 1 to 16 carbon atoms, most preferably 1 to 12 carbon atoms, such as acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, such as methoxycarbonyl and ethoxycarbonyl; aryloxycarbonyl groups, preferably having 7 to 20 carbon atoms, more preferably 7 to 16 carbon atoms, most preferably 7 to 10 carbon atoms, such as phenyloxycarbonyl; acyloxy groups, preferably having 2 to 20 carbon atoms, more preferably 2 to 16 carbon atoms, most preferably 2 to 10 carbon atoms, such as acetoxy and benzoyloxy; acylamino groups, preferably having 2 to 20 carbon atoms, more preferably 2 to 16 carbon atoms, most preferably 2 to 10 carbon atoms, such as acetylamino and benzoylamino; alkoxycarbonylamino groups, preferably having 2 to 20 carbon atoms, more preferably 2 to 16 carbon atoms, most preferably 2 to 12 carbon atoms, such as methoxycarbonylamino; aryloxycarbonylamino groups, preferably having 7 to 20 carbon atoms, more preferably 7 to 16 carbon atoms, most preferably 7 to 12 carbon atoms, such as phenyloxycarbonylamino; sulfonylamino groups, preferably having 1 to 20 carbon atoms, more preferably 1 to 16 carbon atoms, most preferably 1 to 12 carbon atoms, such as methanesulfonylamino and benzenesulfonylaminc; sulfamoyl groups, preferably having 0 to 20 carbon atoms, more preferably 0 to 16 carbon atoms, most preferably 0 to 12 carbon atoms, such as sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, such as carbamoyl, methylcarbamoyl, diethylcarbamoyl, and phenylcarbamoyl; alkylthio groups, preferably havirnrag 1 to 20 carbon atoms, more preferably 1 to 16 carbon atoms, most preferably 1 to 12 carbon atoms, such as methylthio and ethylthio; arylthio groups, preferably having 6 to 20 carbon atoms, more preferably 6 to 16 carbon atoms, most preferably 6 to 12 carbon atoms, such as phenylthio; sulfonyl groups, preferably having 1 to 20 carbon atoms, more preferably 1 to 16 carbon atoms, most preferably 1 to 12 carbon atoms, such as mesyl and tosyl; sulfinyl groups, preferably having 1 to 20 carbon atoms, more preferably 1 to 16 carbon atoms, most preferably 1 to 12 carbon atoms, such as methanesulfinyl and benzenesulfinyl; ureido groups, preferably having 1 to 20 carbon atoms, more preferably 1 to 16 carbon atoms, most preferably 1 to 12 carbon atoms, such as ureido, methylureido, and phenylureido; phosphoramide groups, preferably having 1 to 20 carbon atoms, more preferably 1 to 16 carbon atoms, most preferably 1 to 12 carbon atoms, such as diethylphosphoramide and phenylphosphoramide; hydroxy groups; mercapto groups; halogen atoms such as fluorine, chlorine, bromine and iodine atoms; cyano groups; sulfo groups; carboxyl groups; nitro groups; hydroxarrmic acid groups; sulfino groups; hydrazino groups; and heterocyclic groups such as imidazolyl, pyridyl, furyl, piperidyl, and morpholino. These substituents may be further substituted. Where two or more substituents are attached, they may be the same or different.

R is preferably selected from alkyl, aryl, alkoxy, aryloxy, cyano, halogen and nitro groups, more preferably from alkyl, aryl, alkoxy, aryloxy and halogen groups, further preferably from alkyl, aryl and alkoxy groups, and most preferably from alkyl and aryl groups.

Letter m is an integer of 1 to 4. When m≧2, a plurality of R groups may be the same or different, and when a plurality of R groups are close to each other, they may form aliphatic, aromatic or heterocyclic rings (e.g., benzene or dioxolene rings.

Of the compounds of formula (I), compounds of the following general formula (I-a) are preferred.

(I-a)

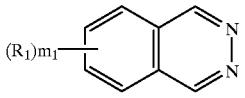

In formula (I-a), $R_1$ is an alkyl, aryl, alkoxy, aryloxy, halogen, cyano or nitro group, and $m_1$ is an integer of 1 to 4, with the proviso that when $m_1 \geqq 2$, a plurality of $R_1$ groups may be the same or different, and when a plurality of $R_1$ groups are close to each other, they may form an aliphatic, aromatic or heterocyclic ring.

When $R_1$ is alkyl, aryl, alkoxy or aryloxy, the preferred ranges of these groups are the same as described for R in formula (I).

Of the compounds of formula (I), compounds of the following formula (I-b), (I-c) or (I-d) are more preferred.

(I-b)

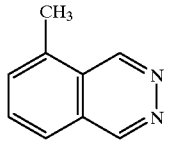

(I-c)

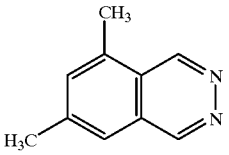

(I-d)

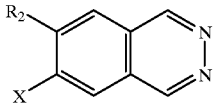

Herein, $R_2$ is alkyl, and X is hydrogen or a substituent. The substituents represented berg X are as previously described for the substituents represented by R.

X is preferably selected from hydrogen, alkyl groups, aryl groups and halogen atoms, more preferably from hydrogen, alkyl groups and aryl groups, and most preferably from hydrogen and alkyl groups.

The alkyl groups represented by $R_2$ include normal, branched or cyclic alkyl groups having 1 to 30 carbon atoms, preferably 1 to 20 carbon atoms, more preferably 1 to 12 carbon atoms, most preferably 1 to 8 carbon atoms, for example, methyl, ethyl, n-propyl, iso-propyl, n-butyl, iso-butyl, tert-butyl, n-octyl, n-decyl, n-hexadecyl, cyclopropyl, cyclopentyl, and cyclohexyl.

The alkyl groups represented by $R_2$ may have substituents, examples of which are the same as the substituents represented by X except for the alkyl groups.

Preferred examples of the substituents that $R_2$ may possess include aryl, amino, alkoxy, aryloxy, acyl, acylamino, sulfonylamino, ureido, alkoxycarbonylamino, aryloxycarbonyl, hydroxy, halogen and heterocyclic groups. More preferred are aryl, alkoxy, aryloxy, acyl, acylamino, sulfonylamino, hydroxy, halogen and heterocyclic groups. Most preferred are aryl, alkoxy, aryloxy, hydroxy, halogen and heterocyclic groups.

$R_2$ is preferably selected from unsubstituted, normal, branched or cyclic alkyl groups.

It is preferred that in formula (I-d), X is hydrogen and $R_2$ is alkyl of at least 4 carbon atoms, including normal, branched or cyclic alkyl of preferably 4 to 30 carbon atoms, more preferably 4 to 20 carbon atoms, further preferably 4 to 12 carbon atoms, most preferably 4 to 8 carbon atoms, for example, n-butyl, iso-butyl, tert-butyl, n-octyl, tert-octyl, n-decyl, n-hexadecyl, cyclopropyl, cyclopentyl and cyclohexyl.

Of the groups represented by $R_2$, branched groups such as iso-butyl, tert-butyl, and tert-octyl are especially preferred.

Illustrative, non-limiting, examples of the compound of the general formula (I) are given below.

I-1

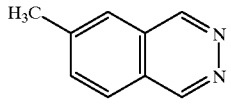

I-2

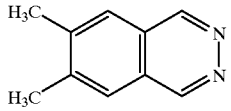

I-3

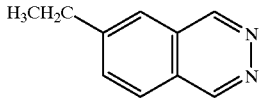

I-4

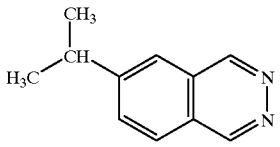

I-5

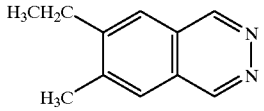

I-6

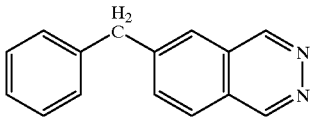

I-7

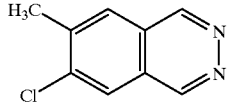

-continued
I-8
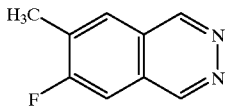
I-9
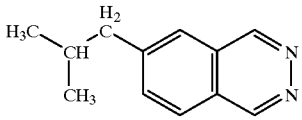
I-10
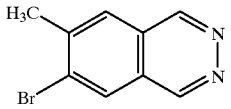
I-11
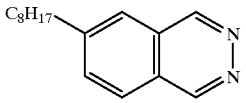
I-12
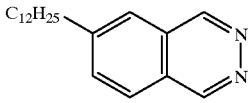
I-13
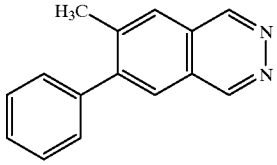
I-14
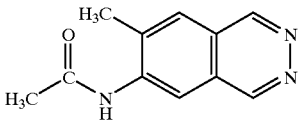
I-15
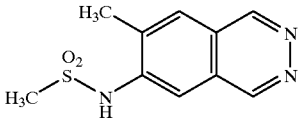
I-16
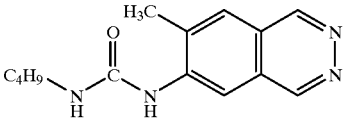
I-17
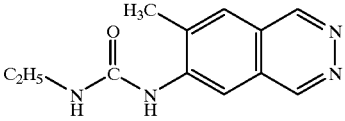
-continued
I-18
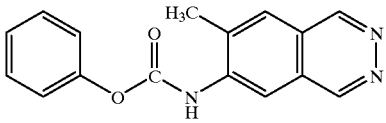
I-19
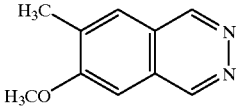
I-20
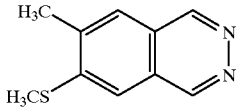
I-21
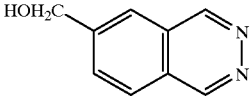
I-22
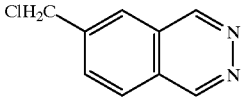
I-23
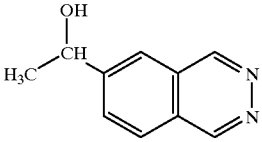
I-24
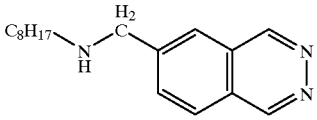
I-25
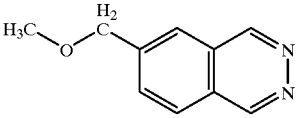
I-26
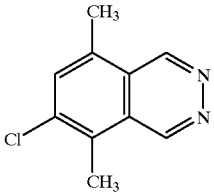
I-27
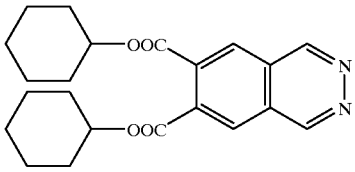

-continued
I-28
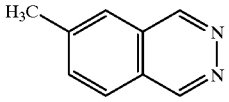
I-29
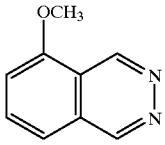
I-30
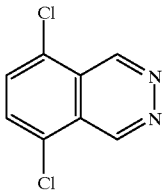
I-31
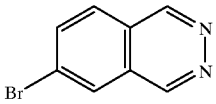
I-32
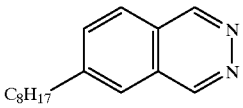
I-33
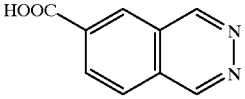
I-1-1
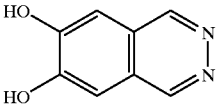
I-1-2
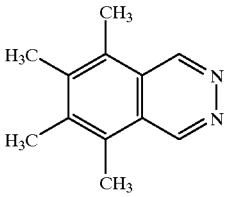
I-1-3
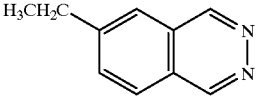
I-1-4
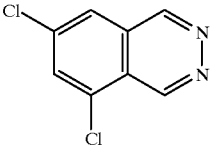
-continued
I-1-5
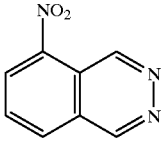
I-1-6
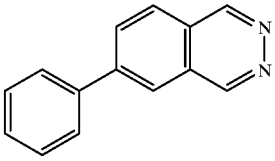
I-1-7
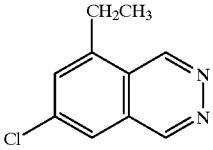
I-1-8
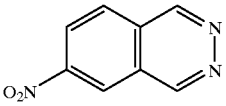
I-1-9
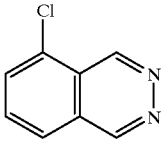
I-1-10
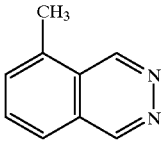
I-1-11
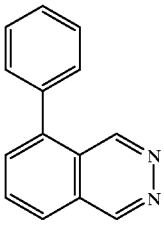
I-1-12
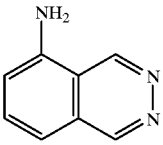
I-1-13
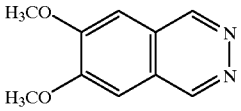

-continued
I-1-14
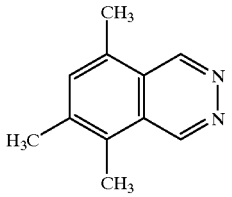
I-1-15
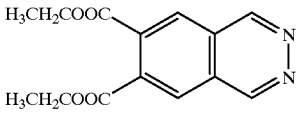
I-1-16
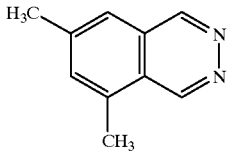
I-1-17
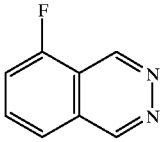
I-1-18
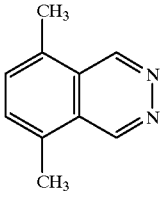
I-1-19
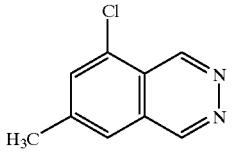
I-1-20
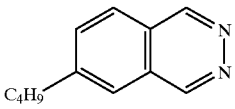
I-1-21
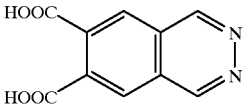
I-1-22
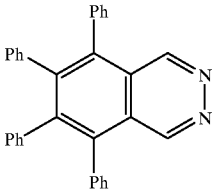
-continued
I-1-23
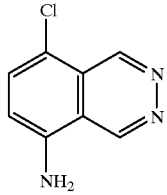
I-1-24
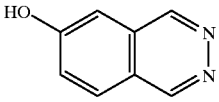
I-1-25
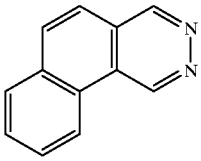
I-1-26
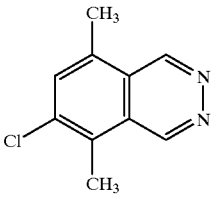
I-1-27
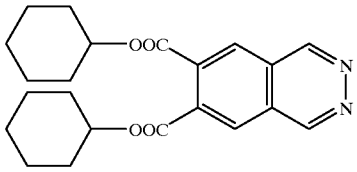
I-1-28
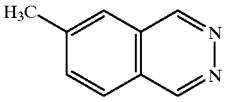
I-1-29
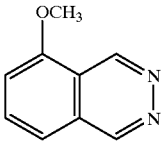
I-1-30
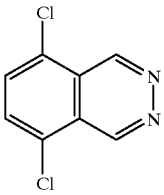
I-1-31
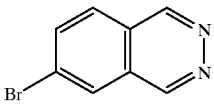

-continued
I-1-33
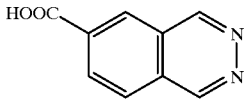
I-1-32
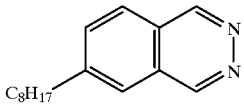
I-1-33
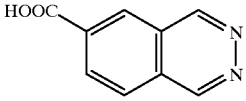
I-1-34
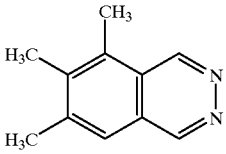
I-1-35
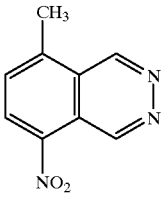
I-1-36
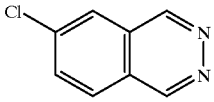
I-1-37
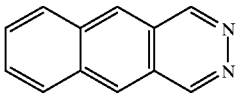
I-1-38
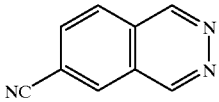
I-1-39
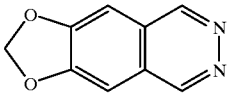
I-1-40
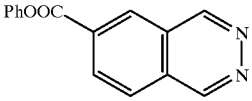
-continued
I-1-41
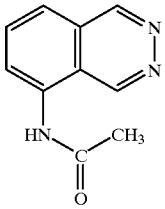
I-1-42
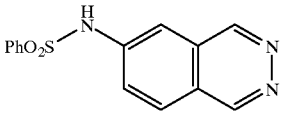
I-1-43
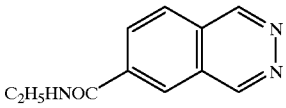
I-1-44
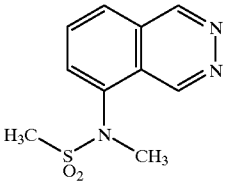
I-1-45
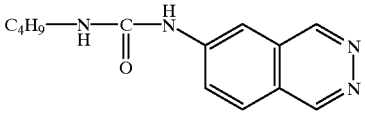
I-1-46
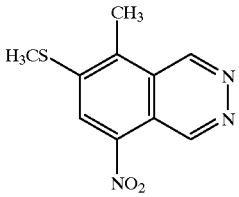
I-1-47
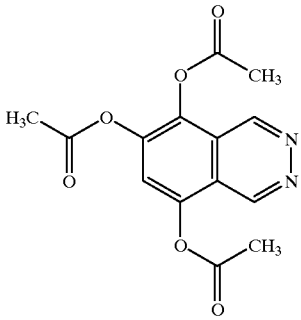

-continued

I-1-48

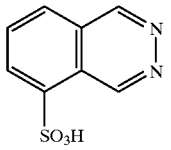

The compounds of the general formula (I) can be synthesized by well-known methods as disclosed, for example, in R. G. ElderField, "Heterocyclic Compounds," John Wiley and Sons, Vol. 1–9, 1950–1969 and A. R. Katritzky, "Comprehensive Heterocyclic Chemistry," Pergamon Press, 1984.

Most of well-known methods are basically to form phthalazine skeletons by synthesizing corresponding phthalic acid derivatives (e.g., phthalaldehyde, phthalic anhydride and phthalates) and condensing them with hydrazine. It is also possible to synthesize the relevant compounds from cyclization reaction of arylaldazine derivatives as described in Tetrahedron Letters, 22, 345 (1981).

As typical synthesis examples of the compounds of the general formula (I), the synthesis of Exemplary Compound I-9 and I-26 is described below.

SYNTHESIS EXAMPLE 1

Synthesis of Exemplary Compound I-9

(1) N,N'-bis(4-isobutylbenzylidene)hydrazine

A 3-liter three-necked flask was charged with 638.5 g (3.94 mol) of 4-isobutylbenzaldehyde and 1 liter of methanol, which were stirred for mixing by a mechanical stirrer. While the reactor was cooled with water so as to maintain the temperature of the reaction solution below 50° C., 98.5 g (1.97 mol) of hydrazine monohydrate was slowly added dropwise. After the completion of addition, the reaction solution was heated under reflux for 30 minutes and then allowed to stand one day.

With stirring, the reaction mixture in which the end product precipitated was cooled below 5° C. The precipitate was collected by suction filtration, washed by splashing 500 ml of cold methanol, and dried, obtaining 615.9 g of the end product. The yield was 97.6%.

(2) Exemplary Compound I-9

A 1-liter three-necked flask was charged with 36.2 g (0.113 mol) of the N,N'-bis(4-isobutylbenzylidene) hydrazine synthesized above, 100 g (0.75 mol) of anhydrous aluminum chloride, and 100 g (0.375 mol) of anhydrous aluminum bromide, which were heated and melted at 190° C. and reacted for 40 minutes. At the end of reaction, the hot reaction mixture was poured into 1 liter of ice water whereby it was dissolved and deactivated. This was adjusted to about pH 1 by adding conc. hydrochloric acid. After 20 minutes of stirring, the insoluble tar component was filtered off with Celite.

The acidic aqueous solution thus obtained was adjusted to pH 10 or higher by adding potassium hydroxide. Ethyl acetate was added to this for extracting the organic matter. The extract liquid was dried, concentrated and purified by silica gel chromatography (silica gel 500 g, developer solvent: ethyl acetate), obtaining 5.5 g of Compound I-9. Yield 26%, and boiling point 132–136° C. (0.4 Torr).

SYNTHESIS EXAMPLE 2

Synthesis of Exemplary Compound I-26

(1) α,α,α',α'-tetrabromo-4-tert-butyl-o-xylene

A 1-liter three-necked flask was charged with 195 g (1.2 mol) of N-bromosuccinimide and 300 ml of carbon tetrachloride, which were heated under reflux while stirring. A solution containing 40.6 g (0.25 mol) of 4-tert-butyl-o-xylene and 1 g (6 mmol) of azobisbutyronitrile in 300 ml of carbon tetrachloride was separately prepared and added dropwise to the flask over 30 minutes. After the completion of addition, the solution was allowed to react for 4 hours. The reaction solution was coroled to room temperature, 300 ml of water was added thereto, and the mixture was stirred for 1 hour. Extraction with 100 ml of dichloromethane was effected twice. The combined organic layer was dried and concentrated. With 100 ml of n-hexane added to the resulting oil, recrystallization was carried out, obtaining 79 g of the end product. The yield was 66%.

(2) 4-tert-butylphthalaldehyde

A 2-liter three-necked flask was charged with 71.2 g (0.15 mol) of the tetrabromoxylene prepared above and 200 ml of acetic acid, which were heated under reflux for dissolving the xylene derivative. To the heated solution, 650 ml of an aqueous solution of 2M sodium hydroxide was added dropwise over 3 hours. Thereafter, heating was continued for a further 3 hours. After the completion of heating and reaction, the reaction solution was cooled to room temperature. Extraction with 200 ml of dichloromethane was effected twice. The combined organic layer was dried and concentrated. The resulting oil was purified by silica gel chromatography (silica gel 800 g, developer solvent:ethyl acetate/n-hexane=⅕), obtaining 18.7 g of the end product. Yield 65.5%.

(3) Exemplary Compound I-26

In 200 ml of ethanol was dissolved 16 g (84 mmol) of the phthalaldehyde synthesized above. While the solution was cooled below 20° C. with ice water, 4.5 g (90 mmol) of hydrazine monohydrate was added dropwise. After the completion of addition, the reaction solution was warmed to room temperature and left to stand at room temperature for one hour. The solvent was distilled off in vacuum, obtaining crude crystals of the end product. The crude crystals were purified by recrystallization from a solvent mixture of ethyl acetate/n-hexane, obtaining 14.2 g of Exemplary Compound I-26. Yield 91%, and boiling point 121–124° C.

Examination of Volatility by Thermogravimetry

Compounds I-9 and I-26 falling in the scope of the general formula (I) according to the invention and a comparative compound designated A below were measured for a weight loss by heating at 120° C. for 1 hour. A thermogravimetric apparatus used was TG/DTA220 (Seiko Electronic industry K.K.). The results are shown below.

Comparative compound A phthalazine

| Compound | Heating temperature (° C.) | Retention after heating (%) |
|---|---|---|
| Comparative compound A | 124.6–124.6 | 84.6 |
| Compound I-9 | 124.5–124.7 | 96.3 |
| Compound I-26 | 130.9–132.7 | 92.1 |

It is thus evident that the inventive compounds are improved in non-volatility.

The compounds of formula (I) wherein R is nitro, amino, acylamino, alkoxycarbonylamino, aryloxycarbonylamino, sulfonylamino, ureido, and phosphoramide groups are generally synthesized by first synthesizing nitro-substituted phthalazine derivatives, reducing them into amino-substituted phthalazine derivatives, and reacting them with a variety of reactants to introduce the desired substituents. For the nitration of phthalarzine derivatives, the method described in J. Chem. Soc., Perkin Trans., 1, 1993, 211–216 can be utilized.

The compounds of formula (I) wherein R is carboxyl, alkoxycarbonyl, aryloxycarbonyl, and carbamoyl groups are generally synthesized by first synthesizing alkoxycarbonyl-substituted phthalazine derivatives, optionally hydrolyzing the ester group moiety into a carboxyl group, and reacting the phthalazine derivatives whose ester group is unchanged or converted into a carboxyl group with a rvariety of reactants to introduce the desired substituents. The alkoxycarbonyl-substituted phthalazine derivatives can be synthesized by the method described in Heterocycles, 20, 1279 (1983), for example.

The compounds of formula (I) wherein R is mercapto, sulfo, sulfino, sulfamoyl, alkylthio, arylthio, sulfonyl, and sulfinyl groups are generally synthesized by first synthesizing halo-substituted phthalazine derivatives, reacting them with sodium sulfide, alkylmercaptans or arylmercaptans to substitute a mercapto, alkylthio or arylthio group for the halogen atom, and reacting them with a variety of reactants to introduce the desired substituents.

The compounds of formula (I) wherein R is hydroxy, alkoxy, aryloxy, and acyloxy groups are generally synthesized by first synthesizing alkoxy-substituted phthalazine derivatives, eliminating the O-alkyl group, and reacting them with a variety of reactants to introduce the desired substituents. The alkoxy-substituted phthalazine derivatives can be synthesized by the methods described in J. Pharm. Sci., 69, 120 (1980) and J. Org. Chem., 31, 1912 (1966).

The compounds of formula (I) may be added to photographic constituent layers, for example, photosensitive layers and non-photosensitive layers, more specifically, image forming layers (photosensitive layers and heat-sensitive layers), protective layers, and other layers. Preferably, the compounds are added to the same layer as the organic silver salt is contained or a layer adjacent thereto, or the same layer as the silver halide is contained or a layer adjacent thereto.

The compounds of formula (I) are preferably added in amounts of $10^{-4}$ to 1 mol, more preferably $10^{-3}$ to 0.3 mol, most preferably $10^{-3}$ to 0.1 mol, per mol of silver although the amount varies with a particular purpose. The compounds of formula (I) may be used alone or in admixture of two or more.

The compounds of formula (I) may be added in any desired form such as solution, powder or solid particle dispersion. The solid particle dispersion may be prepared by well-known comminuting means such as ball mills, vibrating ball mills, sand mills, colloidal mills, jet mills, and roller mills. Dispersing aids may be used for facilitating dispersion. The compounds of formula (I) are preferably added as a solid particle dispersion.

FORMULA (II)

The organic acid compounds of the general formula (II) are described in detail.

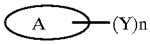

(II)

A is an n-valent monocyclic or fused ring aromatic ring group. The monocycles or fused aromatic rings in the aromatic rings represented by A are preferably monocycles or fused aromatic rings having 6 to 30 carbon atoms, more preferably monocycles or fused aromatic rings having 6 to 18 carbon atoms, most preferably monocycles or fused aromatic rings having 6 to 12 carbon atoms, for example, benzene, naphthalene and anthracene.

The n-valent monocyclic or fused ring aromatic ring group represented by A may have one or more substituents other than Y. In addition to the number n of Y, A may have another Y as a substituent. Examples of such substituents include alkyl groups, preferably having 1 to 20 carbon atoms, more preferably 1 to 12 carbon atoms most preferably 1 to 8 carbon atoms, such as methyl, ethyl, n-propyl, iso-propyl, n-butyl, iso-butyl, tert-butyl, n-orctyl, n-decyl, n-hexadecyl, cyclopropyl, cyclopentyl, and cyzlohexyl; alkenyl groups, preferably having 2 to 20 carbon atoms, more preferably 2 to 12 carbon atoms, most preferably 2 to 8 carbon atoms, such as vinyl, allyl, 2-butenyl, and 3-pentenyl; alkynyl groups, preferably having 2 to 20 carbon atoms, more preferably 2 to 12 carbon atoms, most preferably 2 to 8 carbon atoms, such as propargyl and 3-pentynyl; aryl groups, preferably having 6 to 30 carbon atoms, more preferably 6 to 20 carbon atoms, most preferably 6 to 12 carbon atoms, such as phenyl, p-methylphenyl, and naphthyl; amino groups, preferably having 0 to 20 carbon atoms, more preferably 0 to 10 carbon atoms, most preferably 0 to 6 carbon atoms, such as amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, such as methoxy, ethoxy, and butoxy; aryloxy groups, preferably having 6 to 20 carbon atoms, more preferably 6 to 16 carbon atoms, most preferably 6 to 12 carbon atoms, such as phenyloxy and 2-naphthyloxy; acyl groups, preferably having 1 to 20 carbon atoms, more preferably 1 to 16 carbon atoms, most preferably 1 to 12 carbon atoms, such as acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, such as methoxycarbonyl, ethoxycarbonyl and tetradecyloxycarbonyl; aryloxycarbonyl groups, preferably having 7 to 20 carbon atoms, more preferably 7 to 16 carbon atoms, most preferably 7 to 10 carbon atoms, such as phenyloxycarbonyl; acyloxy groups, preferably having 2 to 20 carbon atoms, more preferably 2 to 16 carbon atoms, most preferably 2 to 10 carbon atoms, such as acetoxy and benzoyloxy; acylamino groups, preferably having 2 to 20 carbon atoms, more preferably 2 to 16 carbon atoms, most preferably 2 to 10 carbon atoms, such as acetylamino, propionylamino and benzoylamino; alkoxycarbonylamino groups, preferably having 2 to 20 carbon atoms, more preferably 2 to 16 carbon atoms, most preferably 2 to 12 carbon atoms, such as methoxycarbornylamino; aryloxycarbonylamino groups, preferably having 7 to 20 carbon atoms, more preferably 7 to 16 carbon atoms, most preferably 7 to 12 carbon atoms, such as prlienyloxycarbonylamino; sulfonylamino groups, preferably having 1 to 20 carbon atoms, more preferably 1 to 16 carbon atoms, most preferably 1 to 12 carbon atoms, such as methanesulfonylamino, octanesulfonylamino and benzenesulfonylamino; sulfamoyl groups, preferably having 0 to 20 carbon atoms, more preferably 0 to 16 carbon atoms, most preferably 0 to 12 carbon atoms, such as sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, such as carbamoyl, methylcarbamoyl, diethylcarbamoyl, and phenylcarbamoyl; alkylthio groups, preferably having 1 to 20 carbon atoms, more preferably 1 to 16 carbon atoms, most preferably 1 to 12 carbon atoms, such as methylthio and ethylthio; arylthio groups, preferably having 6 to 20 carbon atoms, more preferably 6 to 16 carbon atoms, most preferably 6 to 12 carbon atoms, such as phenylthio; sulfonyl groups, preferably having 1 to 20 carbon atoms, more preferably 1 to 16 carbon atoms, most preferably 1 to 12 carbon atoms, such as mesyl and tosyl; sulfinyl groups, preferably having 1 to 20 carbon atoms, more preferably 1 to 16 carbon atoms, most preferably 1 to 12 carbon atoms, such as methanesulfinyl and benzenesulfinyl; ureido groups, preferably having 1 to 20 carbon atoms, more preferably 1 to 16 carbon atoms, most preferably 1 to 12 carbon atoms, such as ureido, methylureido, and phenylureido; phosphoramide groups, preferably having 1 to 20 carbon atoms, more preferably 1 to 16 carbon atoms, most preferably 1 to 12 carbon atoms, such as diethylphosphoramide and phenylphosphoramide; hydroxy groups; carboxyl groups; sulfo groups; sulfino (or sulfinic acid) groups; mercapto groups; halogen atoms such as fluorine, chlorine, bromine and iodine atoms; cyano groups; nitro groups; hydroxamic acid groups; hydrazino groups; and heterocyclic groups such as imidazolyl, pyridyl, furyl, piperidyl, and morpholino. Among the foregoing substituents, those substituents capable of forming a salt with an alkali metal or the like may take the form of a salt. These substituents may be further substituted. Where there are two or more substituents, they may be identical or different.

Preferred substituents are alkyl, alkenyl, aryl, alkoxy, aryloxy, acyl, acyloxy, alkoxycarbonyl, acylamino, alkoxycarbonylamino, aryloxycarbonylamino, sulfonylamino, sulfamoyl, carbamoyl, ureido, phosphoramide, hydroxy, carboxyl, sulfo, sulfino, sulfonyl, halogen, cyano, nitro, and heterocyclic groups. More preferred substituents are alkyl, aryl, alkoxy, aryloxy, acyl, acylamino, alkoxycarbonylamino, aryloxycarbonylamino, sulfonylamino, sulfamoyl, carbamoyl, hydroxy, sulfonyl, halogen, cyano, and nitro groups. Further preferred substituents are alkyl, aryl, alkoxy, aryloxy, acyl, acylamino, sulfonylamino, sulfamoyl, carbamoyl, hydroxy, sulfonyl, halogen, and cyano groups. Most preferred substituents are alkyl, aryl, and alkoxy groups.

Y is —COOH, —$SO_2H$ or —$SO_3H$. Y may take the form of a salt with an alkali metal or the like. Letter n is equal to 1 or 2.

Preferred among the organic acid compounds of formula (II) are compounds of the general formula (II-a):

(II-a)

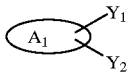

wherein $A_1$ is a phenylene or naphthylene group, and each of $Y_1$ and $Y_2$ is —COOH, —$SO_2H$ or —$SO_3H$. $Y_1$ and $Y_2$ may take the form of a salt with an alkali metal or the like. $Y_1$ and $Y_2$ are attached to $A_1$ in the ortho or meta relationship.

The phenylene or naphthylene groups represented by $A_1$ may have substituents in addition to $Y_1$ and $Y_2$, the preferred range of the substituent being the same as the substituent that A may have in addition to Y.

Preferably $Y_1$ and $Y_2$ are —COOH or —$SO_3H$, more preferably —COOH. The attachment of $Y_1$ and $Y_2$ to $A_1$ is in the ortho or meta relationship, preferably in the ortho relationship.

More preferred among the organic acid compounds of formula (II) are compounds of the general formula (II-b):

(II-b)

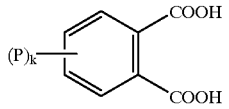

wherein P is an alkyl, aryl, alkoxy or nitro group, k is an integer of 1 to 4, with the proviso that when k≧2, a plurality of P groups may be the same or different. Preferably, k is equal to 1 or 2, most preferably equal to 1.

Most preferred among the organic acid compounds of formula (II) is the compound of the formula (II-c).

(II-c)

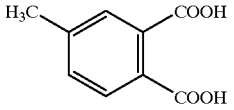

Illustrative, non-limiting, examples of the compound of the general formula (II) are given below, including the compound of formula (II-c).

II-1

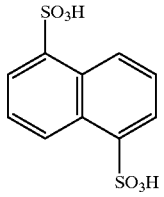

II-2

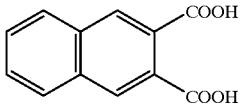

II-3

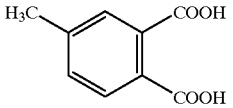

II-4

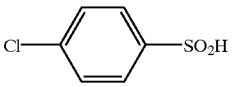

II-5

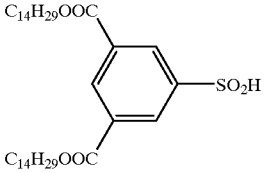

II-6

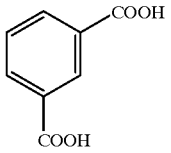

-continued
II-7
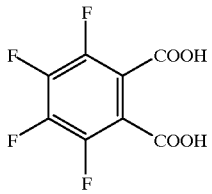
II-8
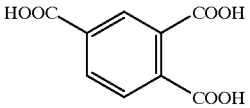
II-9
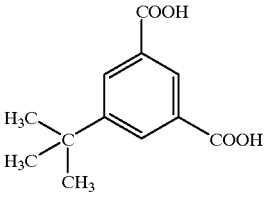
II-10
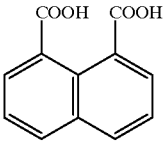
II-11
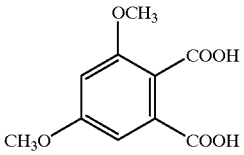
II-12
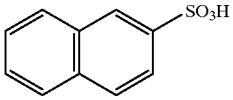
II-13
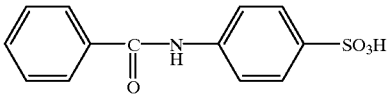
II-14
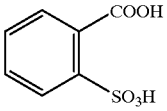
II-15
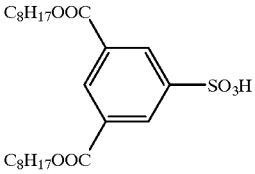
II-16
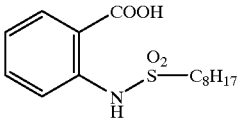
-continued
II-17
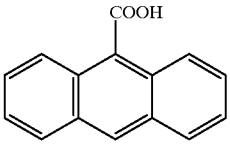
II-18
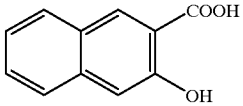
II-19
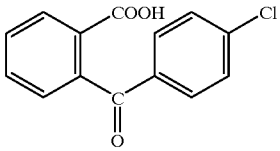
II-20
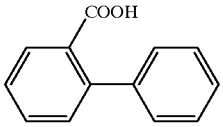
II-21
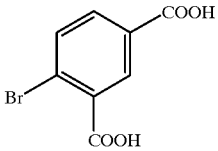
II-22
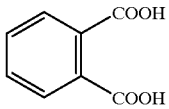
II-23
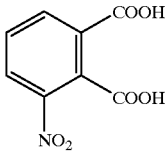
(II-24)
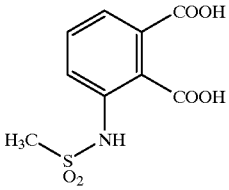
(II-25)
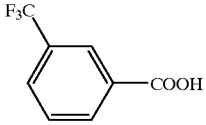
(II-26)
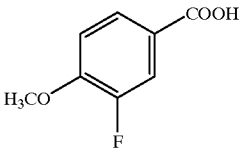

-continued (II-27)

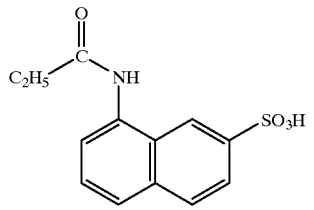

(II-28)

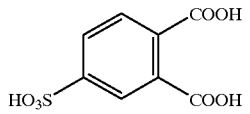

(II-29)

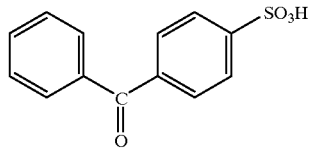

(II-30)

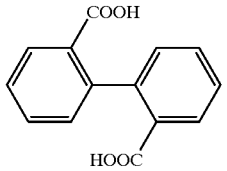

(II-31)

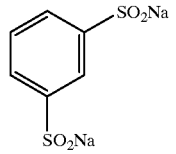

(II-32)

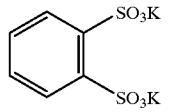

(II-33)

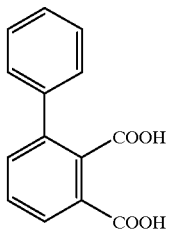

The compounds of formula (II) wherein Y is —$SO_2H$ or —$SO_3H$ can be synthesized by well-known methods as described in New Experimental Chemistry Series, Maruzene K. K., 14-III, Chapters 8-8 and 8-13, and Organic Functional Group Preparations, Academic Press, New York and London, Chapter I-21. The compounds of formula (II) wherein Y is —COOH can be synthesized by well-known methods as described in New Experimental Chemistry Series, Maruzene K. K., 14-III, Chapter 5-1, and Organic Functional Group Preparations, Academic Press, New York and London, Chapter I-9. Various commercially available reagents may also be used.

The compounds of formula (II) may be added to either photosensitive layers or non-photosensitive layers. Broadly for image forming elements, the compounds of formula (II) may be added to image forming layers or other layers.

The compounds of formula (II) are preferably added in amounts of $10^{-4}$ to 1 mol, more preferably $10^{-3}$ to 0.3 mol, most preferably $10^{-3}$ to 0.1 mol, per mol of silver although the amount varies with a particular purpose. The compounds of formula (II) may be used alone or in admixture of two or more.

The compounds of formula (II) may be added in any desired form such as solution, powder or solid particle dispersion. The solid particle dispersion meray be prepared by well-known comminuting means such as ball mills, vibrating ball mills, sand mills, colloidal mills, jet mills, and roller mills. Dispersing aids may be used for facilitating dispersion.

FORMULA (III)

The polyhalide compounds of the general formula (III) are described in detail.

(III)

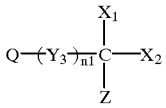

Q is an alkyl, aryl or heterocyclic group. The aryl groups represented by Q may be monocyclic or reused, and are preferably monocyclic or bicyclic aryl groups having 6 to 30 carbon atoms (e.g., phenyl and naphthyl), more preferably phenyl and naphthyl groups, and most preferably phenyl groups.

The heterocyclic groups represented by Q are 3- to 10-membered, saturated or unsaturated, heterocyclic groups containing at least one atom of nitrogen (N), oxygen (O) and sulfur (S). They may be monocyclic or form a fused ring with another ring.

The heterocyclic groups are preferably 5- or 6-membered unsaturated heterocyclic groups which may drive a fused ring, more preferably 5- or 6-membered aromatic heterocyclic groups which may have a fused ring, further preferably 5- or 6-membered aromatic heterocyclic groups containing one or more nitrogen atoms, and most preferably 5- or 6-membered aromatic heterocyclic groups containing 1 to 4 nitrogen atoms which may have a fused ring.

Illustrative examples of the heterocycle in the heterocyclic group include pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxarzole, benzothiazole, benzoselenazole, indolenine, and tetraazaindene. Preferred heterocycles are imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, indolenine, and tetraazaindene. More preferred are imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzothiazole, and tetraazaindene. Further preferred are imidazole, pyridine, pyrimidine, pyrazine, pyrridazine, triazole, triazine, thiadiazole, quinoline, phthalazine, naphthyridine, quinoxaline, quinazoline, cinnoline, tetrazole, thiazole, benzimidazole, and benzothiazole. Most preferred are pyridine, thiadiazole, quinoline, and benzothiazole.

The aryl and heterocyclic groups represented by Q may have one or more substituents other than $—(Y_3)_{n1}—CZ(X_1)(X_2)$. Examples of the substituents include alkyl groups, preferably having 1 to 20 carbon atoms, more preferably 1 to 12 carbon atoms, most preferably 1 to 8 carbon atoms, such as methyl, ethyl, n-propyl, iso-propyl, n-butyl, iso-butyl, tert-butyl, n-octyl, n-decyl, n-hexadecyl, cyclopropyl, cyclopentyl, and cyclohexyl; alkenyl groups, preferably having 2 to 20 carbon atoms, more preferably 2 to 12 carbon atoms, most preferably 2 to 8 carbon atoms, such as vinyl, allyl, 2-butenyl, and 3-pentenyl; alkynyl groups, preferably having 2 to 20 carbon atoms, more preferably 2 to 12 carbon atoms, most preferably 2 to 8 carbon atoms, such as propargyl and 3-pentynyl; aryl groups, preferably having 6 to 30 carbon atoms, more preferably 6 to 20 carbon atoms, most preferably 6 to 12 carbon atoms, such as phenyl, p-methylphenyl, and naphthyl; amino groups, preferably having 0 to 20 carbon atoms, more preferably 0 to 10 carbon atoms, most preferably 0 to 6 carbon atoms, such as amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, such as methoxy, ethoxy, and butoxy; aryloxy groups, preferably having 6 to 20 carbon atoms, more preferably 6 to 16 carbon atoms, most preferably 6 to 12 carbon atoms, such as phenyloxy and 2-naphthyloxy; acyl groups, preferably having 1 to 20 carbon atoms, more preferably 1 to 16 carbon atoms, most preferably 1 to 12 carbon atoms, such as acetyl, benzoyl, formyl, and pivaloyl; alkoxycarbonyl groups, preferably having 2 t:o 20 carbon atoms, more preferably 2 to 16 carbon atoms, most preferably 2 to 12 carbon atoms, such as methoxycarbonyl and ethoxycarbonyl; aryloxycarbonyl groups, preferably having 7 to 20 carbon atoms, more preferably 7 to 16 carbon atoms, most preferably 7 to 10 carbon atoms, such as phenyloxycarbonyl; acyloxy groups, preferably having 2 to 20 carbon atoms, more preferably 2 to 16 carbon atoms, most preferably 2 to 10 carbon atoms, such as acetoxy and benzoyloxy; acylamino groups, preferably having 2 to 20 carbon atoms, more preferably 2 to 16 carbon atoms, most preferably 2 to 10 carbon atoms, such as acetylamino and benzoylamino; alkoxycarbonylamino groups, preferably having 2 to 20 carbon atoms, more preferably 2 to 16 carbon atoms, most preferably 2 to 12 carbon atoms, such as methoxycarbonylamino; aryloxycarbonylamino groups, preferably having 7 to 20 carbon atoms, more preferably 7 to 16 carbon atoms, most preferably 7 to 12 carbon atoms, such as phenyloxycarbonylamino; sulfonylamino groups, preferably having 1 to 20 carbon atoms, more preferably 1 to 16 carbon atoms, most preferably 1 to 12 carbon atoms, such as merlthanesulfonylamino and benzenesulfonylamino; sulfamoyl groups, preferably having 0 to 20 carbon atoms, more preferably 0 to 16 carbon atoms, most preferably 0 to 12 carbon atoms, such as sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, such as carbamoyl, methylcarbamoyl, diethylcarbamoyl, and phenylcarbamoyl; alkylthio groups, preferably having 1 to 20 carbon atoms, more preferably 1 to 16 carbon atoms, most preferably 1 to 12 carbon atoms, such as methylthio and ethylthio; arylthio groups, preferably having 6 to 20 carbon atoms, more preferably 6 to 16 carbon atoms, most preferably 6 to 12 carbon atoms, such as phenylthio; sulfonyl groups, preferably having 1 to 20 carbon atoms, more? preferably 1 to 16 carbon atoms, most preferably 1 to 12 carbon atoms, such as mesyl, tosyl and phenylsulfonyl; sulfinyl groups, preferably having 1 to 20 carbon atoms, more preferably 1 to 16 carbon atoms, most preferably 1 to 12 carbon atoms, such as methanesulfinyl and benzenesulfinyl; ureido groups, preferably having 1 to 20 carbon atoms, more preferably 1 to 16 carbon atoms, most preferably 1 to 12 carbon atoms, such as ureido, methylureido, and phenylureido; phosphoramide groups, preferably having 1 to 20 carbon atoms, more preferably 1 to 16 carbon atoms, most preferably 1 to 12 carbon atoms, such as diethylphosphoramide and phenylphosphoramide; hydroxy groups; mercapto groups; halogen atoms such as fluorine, chlorine, bromine rand iodine atoms; cyano groups; sulfo groups; carboxyl groups; nitro groups; hydroxamic acid groups; sulfino groups; hydrazino groups; and heterocyclic groups such as imidazolyl, pyridyl, furyl, piperidyl, and morpholino. These substituents may be further substituted. Where there are two or more substituents, they may be identical or different.

Preferred substituents are alkyl, alkenyl, aryl, alkoxy, aryloxy, acyl, acyloxy, alkoxycarbonyl, aryloxycarbonyl, acylamino, alkoxycarbonylamino, aryloxycarbonylamino, sulfonylamino, sulfamoyl, carbamoyl, sulfonyl, ureido, phosphoramide, halogen, cyano, sulfo, carboxyl, nitro, and heterocyclic groups. More preferred substituents are alkyl, aryl, alkoxy, aryloxy, acyl, acylamino, alkoxycarbonylamino, aryloxycarbonylamino, sulfonylamino, sulfamoyl, carbamoyl, ureido, phosphoramide, halogen, cyano, nitro, and heterocyclic groups. Further preferred substituents are alkyl, aryl, alkoxy, aryloxy, acyl, acylamino, sulfonylamino, sulfamoyl, carbamoyl, halogen, cyano, nitro, and heterocyclic groups. Most preferred substituents are alkyl, aryl groups and halogen atoms.

The alkyl groups represented by Q include normal, branched or cyclic alkyl groups, preferably having 1 to 30 carbon atoms, more preferably 1 to 15 carbon atoms, for example, methyl, ethyl, n-propyl, iso-propyl, and tert-octyl.

In addition to $—(Y_3)_{n1}—CZ(X_1)(X_2)$, the alkyl groups represented by Q may have one or more substituents, examples of which are the same as the substituents that the heterocyclic or aryl group represented by Q may have. Preferred substituents are alkenyl, aryl, alkoxy, aryloxy, acyloxy, acylamino, alkoxycarbonylamino, aryloxycarbonylamino, sulfonylamino, alkylthio, arylthio, ureido, phosphoramide, hydroxy, halogen, and heterocyclic groups. More preferred substituents are aryl, alkoxy, aryloxy, acylamino, alkoxycarbonylamino, aryloxycarbonylamino, sulfonylamino, ureido, phosphoramide groups, and halogen atoms. Further preferred substituents are aryl, alkoxy, aryloxy, acylamino, sulfonylamino, ureido, and phosphoramide groups. These substituents may be further substituted. Where there are two or more substituents, they may be identical or different.

$Y_3$ is —C(=O)—, —SO— or $—SO_2—$, preferably —C(=O)— or $—SO_2—$, and more preferably $—SO_2—$. Letter n1 is equal to 0 or 1, preferably equal to 1.

$X_1$ and $X_2$ are halogen atoms, which may be identical or different, such as fluorine, chlorine, bromine and iodine atoms, preferably chlorine, bromine and iodine atoms, more preferably chlorine and bromine atoms, and most preferably bromine atoms.

Z is a hydrogen atom or electron attractive group. The electron attractive groups represented by Z are preferably those substituents having a Hammette's sigma value ($\sigma_p$) of at least 0.01 and more preferably at least 0.1. With reference to Hammette's substituent constant, reference is made to the literature, for example, Journal of Medicinal Chemistry, Vol. 16, No. 11, 1207–1216 (1973). Examples of the electron attractive group include halogen atoms such as fluorine ($\sigma_p$=0.06), chlorine ($\sigma_p$=0.23), bromine ($\sigma_p$=0.23), and iodine ($\sigma_p$=0.18), trihalomethyl groups such as tribromomethyl ($\sigma_p$=0.29), trichloromethyl ($\sigma_p$=0.33) and trifluoromethyl ($\sigma_p$=0.54), cyano groups ($\sigma_p$=0.66), nitro groups ($\sigma_p$=0.78), aliphatic aryl or heterocyclic sulfonyl groups such as methanesulfonyl ($\sigma_p$=0.72), aliphatic aryl or heterocyclic acyl groups such as acetyl ($\sigma_p$=0.50), benzoyl ($\sigma_p$=0.43), alkynyl groups such as C≡CH ($\sigma_p$=0.23), aliphatic aryl or heterocyclic oxycarbonyl groups such as methoxycarbonyl ($\sigma_p$=0.45) and phenoxycarbonyl ($\sigma_p$=0.44), carbamoyl groups ($\sigma_p$=0.36), and sulfamoyl groups ($\sigma_p$=0.57).

Preferably Z represents electron attractive groups, more preferably halogen atoms, aliphatic aryl or heterocyclic sulfonyl groups, aliphatic aryl or heterocyclic acyl groups, aliphatic aryl or heterocyclic oxycarbonyl groups, carbamoyl groups, and sulfamoyl groups, and most preferably halogen atoms of the halogen atoms, chlorine, bromine and iodine atoms are preferred, chlorine and bromine atoms are more preferred, and bromine atoms are most preferred.

Preferred among the compounds of formula (III) are compounds of the following general formula (III-a).

(III-a)

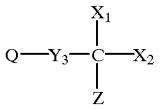

In formula (III-a), Q is as defined in formula (III), with its preferred range being also the same. The substituents that Q may have are the same as the substituents that Q in formula (III) may have. $X_1$, $X_2$, $Y_3$, and Z are as defined in formula (III), with their preferred range being also the same.

Preferred among the compounds of formula (III) are compounds of the following general formula (III-b).

(III-b)

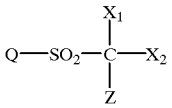

In formula (III-b), Q is as defined in formula (III), with its preferred range being also the same. The substituents that Q may have are the same as the substituents that Q in formula (III) may have. $X_1$, $X_2$, and Z are as defined in formula (III), with their preferred range being also the same.

Illustrative, non-limiting, examples of the compound of the general formula (III) are given below.

III-1

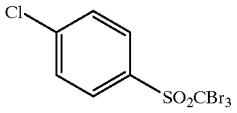

III-2

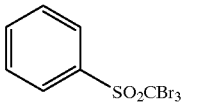

III-3

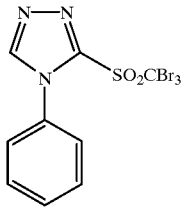

III-4

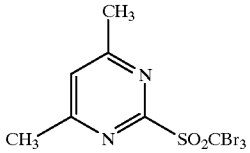

III-5

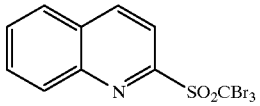

III-6

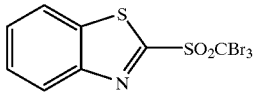

III-7

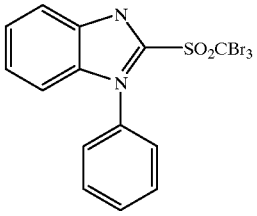

III-8

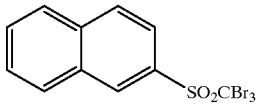

III-9

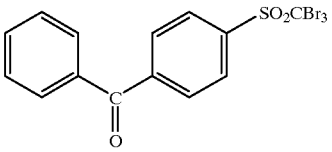

III-10

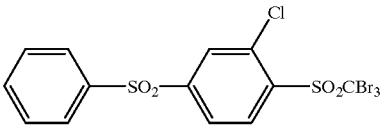

-continued
III-11
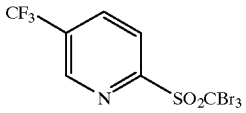
III-12
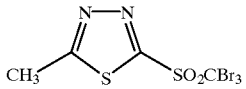
III-13
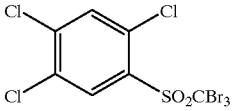
III-14
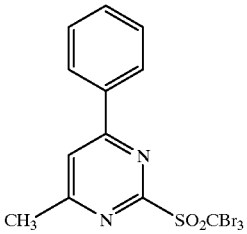
III-15
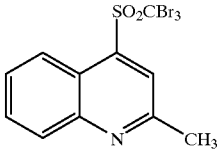
III-16
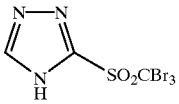
III-17
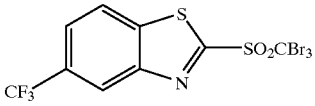
III-18
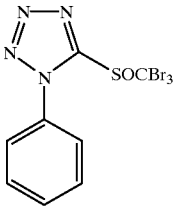
III-19
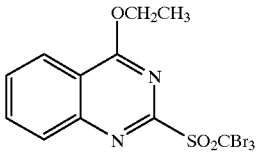
III-20
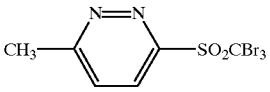
-continued
III-21
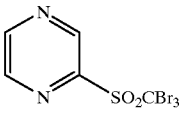
III-22
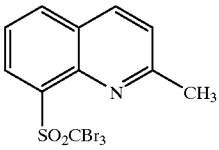
III-23
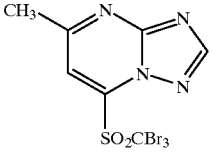
III-24
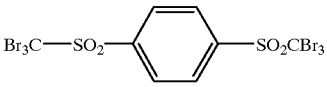
III-25
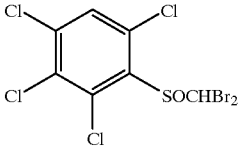
III-26
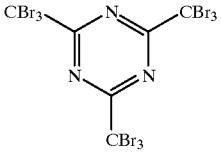
III-27
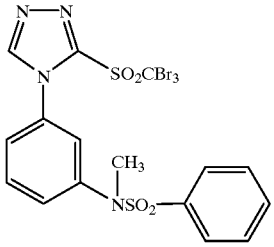
III-28
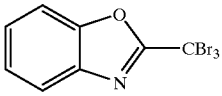
III-29
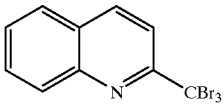
III-30
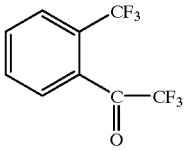

-continued

III-31

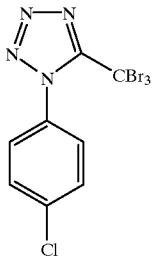

III-32

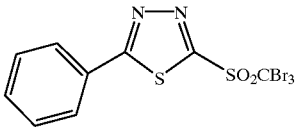

III-33

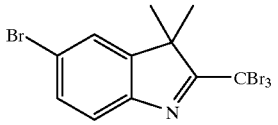

III-34

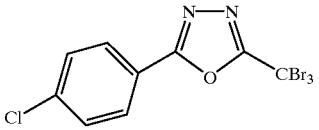

III-35

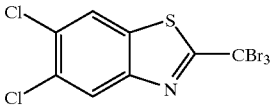

III-36

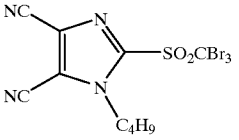

III-37

$CH_3(CH_2)_2CBr_2SO_2CBr_3$

III-38

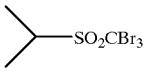

The compounds of formula (III) wherein $Y_3$ is —SO— or —$SO_2$— can be synthesized by first reacting aryl or heterocyclic mercaptan compounds with α-halogenoacetic acid derivatives or α-halogenoacetate derivatives to synthesize α-arylthio or heterocyclic thioacetic acid derivatives, and then oxidizing and brominating the acetic acid derivatives. Also useful are a method of oxidizing and brominating corresponding sulfide derivatives as described in JP-A 304059/1990, and a method of halogenating corresponding sulfone derivatives as described in JP-A 264754/1990.

Conversion to the α-arylthio or heterocyclic thioacetic acid derivatives may be done by reacting corresponding mercaptan compounds with α-halogenoacetic acid derivatives or the like under basic conditions.

With respect to the oxidation and halogenation of α-arylthio or heterocyclic thioacetic acid derivatives, as described in U.S. Pat. No. 3,874,946 and EPA 60598, oxidation and halogenation can be concurrently carried out by adding an α-arylthio or heterocyclic thioacetic acid derivative or a salt thereof to a basic aqueous solution of a hypohalogenous acid or a salt thereof for reaction to take place. Alternatively, the end compounds can be synthesized by converting an α-arylthio or heterocyclic thioacetic acid derivative into a sulfoxide or sulfonyl acetic acid derivative with the aid of an oxidizing agent such as hydrogen peroxide, followed by halogenation.

As to the synthesis of the alkyl, aryl or heterocyclic mercaptan compounds used as the starting reactant, the alkyl and aryl mercaptan compounds can be synthesized by a variety of known methods as described in New Experimental Chemistry Series, Maruzene K. K., 14-III, Chapter 8, 8-1; Sandler & Karo, Organic Functional Group Preparations, Academic Press, New York and London, I—Chapt. 18; and Patai, The Chemistry of Functional Groups, John Wiley & Sons, "The chemistry of the thiol group," Chapt. 4. The heterocyclic mercaptan compounds can be synthesized by a variety of known methods as described in Comprehensive Heterocyclic Chemistry, Pergamon Press, 1984 and Heterocyclic Compounds, John Wiley & Sons, Vol. 1-9, 1950–1967.

The compounds of formula (III) wherein $Y_3$ is —C(=O)— can be synthesized by first synthesizing acetophenone or carbonyl-substituted heterocyclic derivatives, and then α-halogenating the carbonyl compounds. For the α-halogenation of carbonyl compounds, use may be made of methods as described in New Experimental Chemistry Series, Maruzene K. K., 14-I, Chapter 2, for example.

The compounds of formula (III) wherein n1=0 can be synthesized by methylating toluene, xylene or heterocyclic compounds having a methyl group. For halogenation, use may also be made of methods as described in New Experimental Chemistry Series, Maruzene K. K., 14-I, Chapter 2, for example.

In the practice of the invention, the compound of formula (III) is prepared into a solid microparticulate dispersion using a dispersant, in order to provide fine particles of small size and free of flocculation. A solid microparticulate dispersion of the compound of formula (III) may be prepared by mechanically dispersing the compound in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the compound of formula (III) may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxyinethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin.

In general, the dispersant is mixed with the compound of formula (III) in powder or wet cake form prior to dispersion. The resulting slurry is fed into a dispersing machine. Alternatively, a mixture of the dispersant with the compound of formula (III) is subject to heat treatment or solvent treatment to form a dispersant-bearing powder or wet cake of the compound of formula (III). It is acceptable to effect pH control with a suitable pH adjusting agent before, during or after dispersion.

Rather than mechanical dispersion, fine particles can be formed by roughly dispersing the compound of formula (III) in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The location where the compounds of formula (III) are added is not critical. They may be added to image forming layers (photosensitive layers and heat-sensitive layers), protective layers, and other layers. Preferably, the compound is added to the same layer as the organic silver salt is contained or a layer adjacent thereto, or the same layer as the silver halide is contained or a layer adjacent thereto. The compounds of formula (III) may be used alone or in admixture of two or more.

In the third embodiment, the compounds of formula (I) are preferably added on the image forming layer-bearing side in amounts of 0.1 to 50 mol %, more preferably 0.5 to 20 mol %, per mol of silver. The compounds of formula (III) are preferably added on the image forming layer-bearing side in amounts of $1\times10^{-6}$ to 0.5 mol, more preferably $1\times10^{-5}$ to $1\times10^{-1}$ mol, per mol of silver.

Thermo or Photothermorgraphic Image Recording Element

The thermo or photothermographic image recording element has one or more image forming layers on a support. In order that the image recording element become a photosensitive one, at least one layer should contain a substance functioning as a photocatalyst. The preferred photocatalyst is a photosensitive silver halide. Such a photosensitive silver halide may be a component capable of forming a photosensitive silver halide as will be described later. The one layer should preferably further contain an organic silver salt as the reducible silver source, a reducing agent (or developing agent), a binder, and optional agents such as coating aids and auxiliary argents. Further, toners other than those defined herein may be used as well. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive prhotothermographic material, photosensitive layers are distinctly supported by providing a functional or non-functional barrier layer therebetween as described in U.S. Pat. No. 4,460,681.

In one preferred embodiment, the photothermographic element of the invention has at least one photosensitive layer containing photosensitive silver halide grains on one side and a back (or backing) layer on the other side of a support.

Silver Halide

A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver haliders grains and mixing the grains with an organic silver salt. The latter method is preferred in the practice of the invention. The photosensitive silver halide should preferably have a smaller mean grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably at least 50%, more preferably rat least 65%, most preferably at least 80%. Note that the proportion of Miller index {100r} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods which as noodle and flocculation methods although silver halide grains may be either desalted or not according to the invention.

The photosensitive silver halide grains; used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocr(arboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, amincroiminomethanesulfinic acid, hydrazine derivatives, boreane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixincrg the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccininide), halogenated quaternary nitrogen compounds (e.g., tetrarbutylammonium bromide), and aggregates of a halogenated quaternary nitrogen salt and a molecular halogen (e.g., pyridinium bromide perbromide). Any of inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Organic Silver Salt

The organic silver salt which can be used herein is relatively stable to light, but forms a silver image when heated at 80° C. or higher in the presence of an exposed photocatalyst (as typified by a latent imagers of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thin group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver srarilts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thin compounds such as a silver salt of 3-(3-carrlrboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic element of the present invention. That is, as organic silver salt grains constituting image forming regions of photothermographic element increase in size, the covering power becomes smaller and the image density becomes lower. It is thus necessary to reduce the grain size of the organic silver salt. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyl methyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing power or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of the recording element, more preferably about 1 to 3 g/m$^2$.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such was a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituer(nt group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are (described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluorcethanol, 3-methoxy-1-propanol, 3-methoxy-l-butanol, 1-nethoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Reducing Agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For photothermographic elements using organic silver salts, a wide range of reducing agents arErs disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 35 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-rp-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such Eras 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacerzophenone; 5-pyrazolones such as 3-methyl-1-phenyl-5-pyrazolone; reductones such as dimethylaminohexosereductone, anhydrodihydroaminohexosereductone and anhydrodihydropiperidone-hexosereductone; sulfonamidephenol reducing agents such as 2,6-dichloro-4-benzenesulfonamidephenol and p-benzene-sulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. Such a toner may be used in combination with the compound of the general formula (I) according to the invention. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For photothermographic elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, $^{3}$-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N-hexamethylerebis(1-carbamoyl-3,5-dimethylpyrazole), 1,8-(3,6-diazaoctane)-bis(isothiuroniumtrifluoroacetate) and 2-tribromomethylsulfonyl-benzothiazole; 3-ethyl-5-{(3-ethyl-2-benzothiazolinylidene)-1-methylethylidener}-2-thio-2,4-oxazolidinedione; phthalazinone, phthalazinone derivatives or metal salts, or derivatives such as 4-(1-naphthyl)-phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); quinazolinedione, benzoxazine or naphthoxarzine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetra-azapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129815/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $1\times10^{-9}$ mol to $1\times10^{-3}$ mol, more preferably $1\times10^{-8}$ mol to $1\times10^{-4}$ mol per mol of silver coated.

Still further, the photothermographic element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the image recording element, preferably to a layer on the same side as the photosensitive layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ mol to 2 mol, more preferably $1\times10^{-3}$ mol to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-merrcapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercaptc-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

In one preferred embodiment, the phototrhermographic element of the invention is a one-side photosensitive material having at least one photosensitive (or emulsion) layer containing a photosensitive silver halide emulsion on one side and a back (or backing) layer on the other side of the support.

Provided that the photothermographic element has a first outer surface on the photosensitive layer-bearing side and a second outer surface remote from the photosensitive layer with respect to the support, it is preferred that the coefficient of dynamic friction between the first and second outer surfaces is 0.01 to 0.25, more preferably 0.1 to 0.25. The coefficient of dynamic friction ($\mu$) is determined by placing the first and second outer surfaces in close plane contact under a certain weight (a), measuring a force (b) necessary to move one surface relative to the other at a predetermined speed, and dividing the force (b) by the weight (a), that is, $\mu$=b/a.

In a further preferred embodiment, the coefficient of static friction between the first and second outer surfaces is 1.5 to 5 times greater than the coefficient of dynamic friction. The coefficient of static friction is preferably 0.25 to 0.5. The coefficient of static friction is determined by affixing a weight to the second outer surface, placing the second outer surface in close plane contact with the first outer surface, gradually inclining the assembly, and measuring the angle of inclination when the weight starts to move down.

According to the invention, the coefficient of friction may be adjusted using matte agents, surfactants, oil, and other addenda.

In the practice of the invention, a matte agent may be added to the one-side photosensitive element for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinyl-benzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, geletin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary.

No particular limit is imposed on the size and shape of the matte agent. The matte agent used herein may have any desired shape, for example, spherical and irregular shapes. The matte agent of any particle size may be used although matte agents having a particle size of about 0.1 μm to 30 μm, especially about 0.3 to 15 μm are preferably used in the practice of the invention. The particle size distribution of the matte agent may be either narrow (so-called monodisperse) or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

The amount of the matte agent added is preferably about 5 to 200 mg/m$^2$, more preferably about 10 to 150 mg/m$^2$ although the exact addition amount varies with a particular application of the photothermographic element.

In the photothermographic element of the invention, the matte agent may be added to any desired layer. Preferably the matte agent is added to an outermost surface layer, a layer functioning as an outermost surface layer or a layer close to the outer surface, and especially a layer functioning as a so-called protective layer.

In the practice of the invention, the matte agent may be used not only for adjusting a coefficient of friction, but also for improving surface luster, feed and anti-sticking properties.

The surfactants used herein may be nonionic, anionic or cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994. The surfactant may be used not only for adjusting a coefficient of dynamic friction, but also for improving coating and electric charging properties.

Preferred examples of the oil used herein include silicone fluids such as silicone oil and silicone grease and hydrocarbon oils such as wax.

Protective Layer

A surface protective layer may be provided in the photosensitive element according to the present invention for the purpose of preventing sticking of the image forming layer. In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filter dye is preferably used in such an amount as to provide an absorbance of 0.1 to 3, especially 0.2 to 1.5 at the exposure wavelength.

In the photosensitive layer, a variety of dyestuffs may be used from the standpoints of improving tone and preventing irradiation. Any desired dyestuffs may be used in the photosensitive layer according to the invention. Useful dyestuffs include pyrazoloazole dyes, anthraquinone dyes, azo dyes, azomethine dyes, oxonol dyes, carbocyanine dyes, styryl dyes, triphenylmethane dyes, indoaniline dyes, and indophenol dyes. The preferred dyes used herein include anthraquinone dyes (e.g., Compounds 1 to 9 Described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes may be added in any desired form such as solution, emulsion or solid particle dispersion or in a form mordanted with polymeric mordants. The amounts of these compounds used are determined in accordance with the desired absorption although the compounds are generally used in amounts of 1 μg to 1 g per square meter of the element.

In the practice of the invention, an antihalation layer may be disposed on the side of the photosensitive layer remote from the light source. The antihalation layer preferably has a maximum absorbance of 0.3 troo 2 in the desired wavelength range, more preferably an absorbance of 0.5 to 2 at the exposure wavelength, and an absorbance of 0.001 to less than 0.5 in the visible region after processing, and is also preferably a layer having an optical density of 0.001 to less than 0.3.

Where an antihalation dye is used in the invention, it may be selected from various compounds insofar as it has the desired absorption in the wavelength range, is sufficiently low absorptive in the visible region after processing, and provides the antihalation layer with the preferred absorbance profile. Exemplary antihalation dyes are given below though the dyes are not limited thereto. Useful dyes which are used alone are described in JP-A 6458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

Binder

The emulsion layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:3, more preferably from 8:1 to 1:2.

The binder used in the emulsion layer according to the invention may be a hydrophobic polymer dispersed in an aqueous solvent. The "aqueous" solvent is water or a mixture of water and less than 70% by weight of a water-miscible organic solvent. Examples of the water-miscible organic solvent include methanol, ethanol, propanol, ethyl acetate, dimethylformamide, methyl cellosolve, and butyl cellosolve. The "dispersion" means that the polymer is not thermodynamically dissolved in a solvent, but dispersed in an aqueous solvent in a latex, micelle or molecular dispersion form. The polymer used as the binder should preferably have an equilibrium moisture content of up to 2% by weight at 25° C. and RH 60%. The equilibrium moisture content (Weq) of a polymer at 25° C. and RH 60% is calculated according to the following expression:

$$Weq=(W1-W0)/W0\times 100\%$$

using the weight (W1) of the polymer conditioned in an atmosphere of 25° C. and RH 60% until equilibrium is reached and the weight (W0) of the polymer in an absolute dry condition.

The polymer used as the binder is not critical insofar as it is dispersible in the aqueous solvent. Included in the polymer are acrylic resins, polyester resins, polyurethane resins, vinyl chloride resins, vinylidene chloride resins, rubbery resins (e.g., SBR and NBR resins), vinyl acetate resins, polyolefin resins, and polyvinyl acetal resins. The polymer may be either a homopolymer or a copolymer having two or more monomers polymerized together. The polymer may be linear or branched or crosslinked. The polymer preferably has a number average molecule weight Mn of about 1,000 to about 1,000,000, more preferably about 3,000 to about 500,000. Polymers with a number average molecular weight of less than 1,000 would generally provide a low film strength after coating, resulting in a photosensitive material susceptible to crazing.

At least one layer of the image-forming layers, typically photosensitive layers of the photothermographic element according to the invention may be an image forming layer wherein a polymer latex constitutes more than 50% by weight of the entire binder. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included.

With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970.

Dispersed particles should preferably, have a mean particle size of about 1 to 50,000 r=m, more preferably about 5 to 1,000 nm. No particular limit is imposed on the particle size distribution of dispersed particles, and the dispersion may have either a wide particles size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the polymer latex used herein should preferably have an equilibrium moisture content at 25° C. and RH 60% of up to 2% by weight, more preferably up to 1% by weight. The lower limit of equilibrium moisture content is not critical although it is preferably 0.01% by weight, more preferably 0.03% by weight. With respect to the definition and measurement of equilibrium moisture content, reference should be made to "Polymer Engineering Series No. 14, polymer Material Test Methods," Edited by Japanese Polymer Society, Chijin Shokan Publishing K.K., for example.

Illustrative examples of the polymer latex which can be used as the binder in the image-forming layer of the image recording element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer laterxes are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 (Dai-Nippon Ink & Chemicals K.K.). Exemplary rubbery resins are LACSTAR 7310K, 3307B, 4700H and 7132C (Dai-Nippon Ink & Chemicals K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the image-forming layer, typically photosensitive layer according to the invention, the polymer latex described above is preferably used in an amount of at least 50% by weight, especially at least 70% by weight, of the entire binder. In the image-forming layer, typically photosensitive layer according to the invention, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The image-forming layer, typically photosensitive layer according to the invention is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformarriide or ethyl acetate. Exemplary solvent compositions include a 90/10 or 70/30 mixture of water/methanol, a 90/10 mixture of water/ethanol, a 90/10 mixture of water/isopropanol, a 95/5 mixture of water/dimethylformamide, a 80/15/5 or 90/5/5 mixture of water/methanol/dimethylformamide, all expressed in a weight ratio.

In the image-forming layer, typically photosensitive layer according to the invention, the total amount of binder is preferably 0.2 to 30 g/m$^2$, more preferably 1 to 15 g/m$^2$.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion or protective layer surface may have any degree of matte insofar as no star dust failures occur although a Bekk smoothness of 200 to 10,000 seconds, especially 300 to 10,000 seconds is preferred.

Back Layer

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenorx, resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as previously described for the antihalation layer.

The back layer preferably has a degree of matte corresponding to a Bekk smoothness of 10 to 250 seconds, especially 50 to 180 seconds.

A backside resistive heating layer as described in U.S. Pat. Nos. 4,460,681 and 4,374,921 may be used in a photosensitive heat-developable photographic image system according to the present invention.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

Examples of the solvent used herein are described in "New Solvent Pocket Book," Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic photographic emulsion may be coated on a variety of supports. Typical supports include polyester film, subbed polyester film, poly(ethylene terephthalate) film, polyethylene naphthalate film, cellulose nitrate film, cellulose ester film, poly (vinyl acetal) film, polycarbonate film and related or resinous materials, as well as glass, paper, metals, etc. Often used are flexible substrates, typically paper supports, specifically baryta paper and paper supports coated with partially acetyrlated α-olefin polymers, especially polymers of α-olefins having 2 to 10 carbon atoms such as polyethylene, polypropylene, and ethylene-butene copolymers. The supports are either transparent or opaque, preferably transparent.

The photosensitive element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic photographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the thermographic photographic element of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The photosensitive element of the invention may be developed by any desired method although it is generally developed by heating after imagewise exposure. The preferred developing temperature is about 80 to 250° C., more preferably 100 to 140° C. The preferred developing time is about 1 to 180 seconds, more preferably about 10 to 90 seconds.

Any desired technique may be used for the exposure of the photographic element of the invention. The preferred light source for exposure is a laser, for example, a gas laser, YAG laser, dye laser or semiconductor laser. A semiconductor laser combined with a second harmonic generating device is also useful.

Upon exposure, the photographic element of the invention tends to generate interference fringes due to low haze. Known techniques for preventing generation of interference fringes are a technique of obliquely directing laser light to a photosensitive element as disclosed in JP-A 113548/1993 and the utilization of a multi-mode laser as disclosed in WO 95/31754. These techniques are preferably used herein.

Upon exposure of the photographic element of the invention, exposure is preferably made by overlapping laser light so that no scanning lines are visible, as disclosed in SPIE, Vol. 169, Laser Printing 116–128 (1979), JP-A 51043/1992, and WO 95/31754.

The photosensitive element of the invention may be packaged in any desired form. Preferably the photosensitive element takes the form of a sheet. Usually, the photosensitive element is cut into rectangular sheets having rounded corners and 50 to 1,000 sheets are grouped as a set and wrapped in a package. The package for wrapping the photothermographic element is made of a material whose percent absorption of light to which the photothermographic element is sensitive is higher than 99%, especially 99.9 to 100%.

EXAMPLE

Examples of the present invention are given below by way of illustration and not by way of limitation.

The trade names used in Examples have the following meaning. Denka Butyral: polyvinyl butyral by Denki Kagaku Kogyo K.K. BUTVAR: polyvinyl butyral by Monsanto Co. Megafax F-176P: fluorinated surfactant by Dai-Nippon Ink & Chemicals K.K. Sildex H51 and H121: spherical silica having a mean particle size of 5 μm and 12 μm, respectively, by Dokai Chemical K.K. Sumidur N3500: polyisocyanate by Sumitomo-Bayern Urethane K.K. LACSTAR 3307B: styrene-butadiene rubber (SBR) latex, by Dai-Nippon Ink & Chemicals K.K. The polymer has an equilibrium moisture content of 0.6 wt % at 25° C. and RH 60%, and the dispersed particles have a mean particle diameter of about 0.1 to 0.15 μm.

Example 1

Silver Halide Grains A

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing potassium bromide and 0.3 mg of $K_2IrCl_6$ were added over 30 minutes by the controlled double jet method while maintaining the solution at pAg 7.7. The pH of the solution was lowered to cause flocculation and sedimentation for desalting. After 0.1 gram of phenoxyethanol was added, the solution was adjusted to pH 5.9 and pAg 8.2. The solution was heated at 60° C., to which 85 μmol of sodium thiosulfate, 11 μmol of 2,3,4,5,6-pentafluorophenyldiphenylphosphine selenide, 15 μmol of Tellurium Compound 1, 3.3 μmol of chloroauric acid, and 250 μmol of thiocyanic acid were added per mol of silver. The solution was ripened for 120 minutes while stirring, and quenched to 30° C., completing the preparation of silver iodobromide grains A having a silver iodide content of 8 mol % in the core and 2 mol % on the average and an iridium content of $1.4\times10^{-6}$ mol/mol of Ag. The grains had a mean grain size of 0.08 μm, a coefficient of variation of projected area diameter of 8%, and a {100} face proportion of 88%.

Tellurium Compound 1

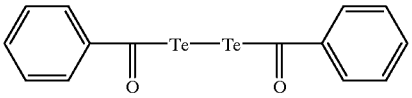

Organic Fatty Acid Silver Emulsion A

While a mixture of 8 grams of stearic acid, 3 grams of arachidic acid, 36 grams of behenic acid, and 860 ml of distilled water was vigorously stirred at 90° C., 187 ml of 1N NaOH aqueous solution was added and the mixture was allowed to react for 60 minutes. Then 65 ml of 1N nitric acid was added and the mixture was cooled to 50° C. The above-prepared silver halide grains A were added to this in such an amount as to give 6.2 mmol of silver halide. Further, 125 ml of an aqueous solution containing 21 grams of silver nitrate was added over 100 seconds and stirring was continued for 10 minutes. Thereafter, 1.24 grams of N-bromosuccinimide was added to the mixture, which was allowed to stand for 10 minutes and then cooled below 30° C. With stirring, 150 grams of butyl acetate was added to the thus prepared aqueous mixture, which was further stirred for extracting all the organic fatty acid silver salt into the butyl acetate phase. The aqueous phase was removed together with the salt contained therein. The butyl acetate phase was further desalted and dewatered until the water finally removed therefrom reached a conductivity of 50 μS/cm. To this, 80 grams of a 2.5 wt % 2-butanone solution of polyvinyl butyral (Denka Butyral #3000-K) was added, followed by agitation. Furthermore, 200 grams of 2-butanone and 59 grams of polyvinyl butyral (BUTVAR® B-76) were added. The mixture was dispersed for 80 minutes by means of a homogenizer. Pyridinium hydrobromide perbromide (PHP), 0.5 mmol, was added to the mixture, which was agitated for 30 minutes, completing the preparation of organic fatty acid silver A.

Emulsion layer coating solution

An emulsion layer coating solution was prepared by adding various chemicals to be above-prepared organic fatty acid silver A in amounts per mol of silver.

| | | |
|---|---|---|
| $CaBr_2$ | 6.5 | mmol |
| 2-mercapto-5-methylbenzimidazole | 7.65 | mmol |
| Sensitizing dye A | 0.7 | mmol |
| 1,1-bis(2-hydroxy-3,5-dimethylphenyl)-3,5,5-trimethylhexane | 0.32 | mol |
| 2-tribromoethylsulfonylbenzothiazole | 24.2 | mmol |
| Inventive tone | (see Table 1) | |
| Comparative compound (phthalazine) | (see Table 1) | |
| Sumidur N3500 isocyanate | 3.6 | g |

Sensitizing dye A

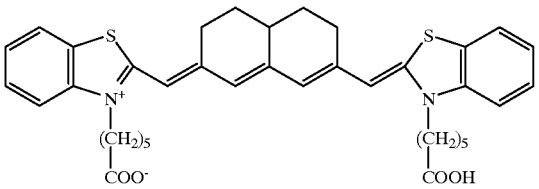

Surface Protective Layer Coating Solution

A surface protective layer coating solution was prepared by mixing the following components.

| | | |
|---|---|---|
| Cellulose acetate butyrate | 7.6 | g |
| 2-butanone | 80 | g |
| Methanol | 10 | g |
| 4,6-ditrichloromethyl-2-phenyltriazine | 0.07 | g |
| Megafax F-176P fluorinated surfactant | 2.6 | g |
| 4-methylphthalic acid | 0.4 | g |

Back layer coating solution

A back layer coating solution was prepared by mixing the following components.

| | | |
|---|---|---|
| Polyvinyl butyral (10 wt % in 2-butanone) | 150 | ml |
| Antihalation Dye 1 | 0.05 | g |
| Megafax F-176P fluorinated surfactant | 0.5 | g |
| Sildex H121 spherical silica (12 $\mu$m) | 0.4 | g |
| Sildex H51 spherical silica (5 $\mu$m) | 0.4 | g |

Antihalation Dye 1

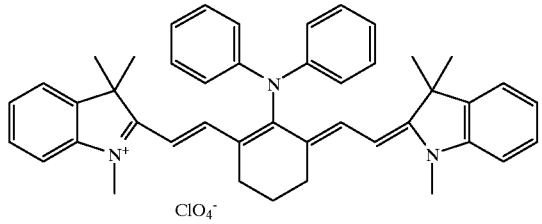

Coated Sample

Onto one surface of a biaxially oriented polyethylene terephthalate (PET) film of 175 $\mu$m thick tinted blue, the back layer coating solution was coated so as to provide an absorbance at 810 nm which was higher by 1.2 than the absorbance of the PET film. The emulsion layer coating solution prepared above was coated on the opposite surface of the PET film so as to provide a silver coverage of 1.8 g/m$^2$. Further, the surface protective layer coating solution was coated onto the emulsion layer so as to provide a cellulose acetate butyrate coverage of 2.5 g/m$^2$. A series of coated samples, Nos. 1 to 8, were obtained in this way (see Table 1).

Photographic Properties

Coated sample Nos. 1 to 8 were exposed imagewise using a modified model of FCR7000 (Fuji Photo Film Co., Ltd.) equipped with a 810-nm semiconductor laser. The angle between the laser beam and the surface of the coated sample exposed thereto was 80 degrees. The exposed samples were developed by uniformly heating at 120° C. for 20 seconds. The thus formed images were examined for sensitivity and fog by means of a densitometer. The sensitivity (S) is the reciprocal of a ratio of the exposure providing a density equal to the fog (Dmin)+1.0, and is expressed in a relative value based on a sensitivity of 100 for coated sample No. 1. The fog was the measurement minus the base density.

Storage Stability Prior to Image Formation

The coated samples were stored in a warm humid atmosphere (35° C., RH 60%) for 5 days. The aged samples were similarly examined for photographic properties for evaluating the stability of photographic properties against aging.

The results are shown in Table 1.

TABLE 1

| Coated | Toner | | Fresh sample photographic properties | | | Aged sample photographic properties | | |
|---|---|---|---|---|---|---|---|---|
| sample | Type | Amount (mol/mol Ag) | Fog | S | Dmax | Fog | S | Dmax |
| 1* | phthalazine | 0.04 | 0.09 | 100 | 3.2 | 0.06 | 38 | 1.4 |
| 2* | phthalazine | 0.07 | 0.11 | 108 | 3.3 | 0.07 | 50 | 1.45 |
| 3 | I-2 | 0.04 | 0.08 | 102 | 3.1 | 0.08 | 103 | 2.9 |
| 4 | I-2 | 0.07 | 0.09 | 109 | 3.2 | 0.1 | 110 | 3 |
| 5 | I-3 | 0.04 | 0.07 | 104 | 3.1 | 0.08 | 105 | 3 |
| 6 | I-3 | 0.07 | 0.09 | 110 | 3.3 | 0.09 | 111 | 3.1 |
| 7 | I-13 | 0.04 | 0.07 | 100 | 3 | 0.08 | 102 | 2.8 |
| 8 | I-13 | 0.07 | 0.08 | 105 | 3.1 | 0.08 | 107 | 2.9 |

*comparison

It is evident from Table 1 that surprisingly, photographic elements using the compounds of the invention produce images having a high density and maintain their photographic properties highly stable even after the storage under warm humid conditions prior to the image formation process.

Example 2

Silver Halide Grains B

In 700 ml of water were dissolved 24 grams of phthalated gelatin and 30 mg of potassium bromide. The solution was adjusted to pH 5.0 at a temperature of 40° C. To the solution, 159 ml of an aqueous solution containing 18.7 grams of silver nitrate and an aqueous solution containing potassium bromide and potassium iodide in a molar ratio of 92:8 were added over 10 minutes by the controlled double jet method while maintaining the solution at pAg 7.8. Then, 476 ml of an aqueous solution containing 55.4 grams of silver nitrate and an aqueous solution containing 7 μmol/liter of dipotassium hexachloroiridate and 1 mol/liter of potassium bromide were added over 30 minutes by the controlled double jet method while maintaining the solution at pAg 7.6. Then, the pH of the solution was lowered to cause flocculation and sedimentation for desalting. With 0.2 gram of phenoxyethanol added, the solution was adjusted to pH 5.9 and pAg 8.0. There were obtained cubic grains having a silver iodide content of 8 mol % in the core and 2 mol % on the average, a mean grain size of 0.07 μm, a coefficient of variation of the projected area diameter of 10%, and a (100) face proportion of 85%.

The thus obtained silver halide grains B were heated at 60° C., to which 85 μmol of sodium thiosulfate, 6 μmol of 2,3,4,5,6-pentafluorophenyldiphenylphosphrhne selenide, 1.7 μmol of Tellurium Compound 1 (used in Example 1), 3.9 μmol of chloroauric acid, and 220 μmol of thiocyanic acid were added per mol of silver. The emulsion was ripened for 120 minutes and then cooled to 50° C. To this, $5\times10^{-4}$ mol of Sensitizing Dye C and $3\times10^{-4}$ mol of Sensitizing Dye D were added per mol of silver halide. Moreover, 3.7 mol % based on the silver of potassium iodide was added to the emulsion, which was agitated for 30 minutes and then reached to 30° C., completing the preparation of silver halide regains B.

Sensitizing Dye C

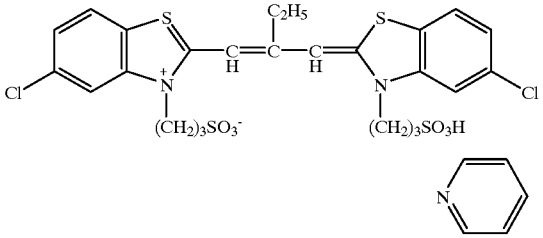

Sensitizing Dye D

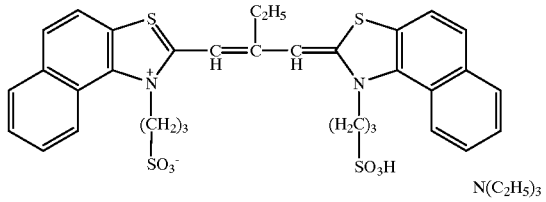

Organic Acid Silver Microcrystalline Dispersion B

A mixture of 40 grams of behenic acid, 7.3 grams of stearic acid, and 500 ml of distilled water was stirred at 90° C. for 20 minutes, 187 ml of a 1N NaOH aqueous solution was added over 15 minutes, then 61 ml of a 1N nitric acid aqueous solution was added. The resulting solution was cooled to 50° C. Then 124 ml of a 1N silver nitrate aqueous solution was added over 2 minutes, and stirring was continued for 40 minutes. Thereafter, the solids were separated by centrifugation and washed with water until the water filtrate reached a conductivity of 30 μS/cm. The thus obtained solids were handled as a wet cake without drying. To 33.4 grams as dry solids of the wet cake were added 12 grams of polyvinyl alcohol and 150 ml of water. They were thoroughly mixed to form a slurry. The slurry was admitted into a dispersing machine Micro-Fluidizer M-110-E/H (manufactured by Microfluidex Corporation, wall impact type chamber). The machine was operated for dispersion under an impact pressure of 500 kg/cm$^2$. There was obtained a microcrystalline dispersion B of needle grains of organic acid silver having a mean minor diameter of 0.04 μm, a mean major diameter of 0.8 μm and a coefficient of variation of the projected area of 35% as determined by electron microscopic observation.

Solid Particle Dispersion of Reducing Agent

To 10 grams of 1,1-bis(2-hydroxy-3,5-dimethylphenyl)-3,5,5-trimethylhexane were added 1.5 grams of hydroxypropyl methyl cellulose and 88.5 ml of water. They were thoroughly agitated to form a slurry, which was allowed to stand for 3 hours. A vessel was charged with the slurry together with 360 grams of zirconia beads having a mean diameter of 0.5 mm. A dispersing machine 1/4G Sand Grinder Mill (manufactured by Imex K.K.) was operated for 3 hours for dispersion, obtaining a solid particle dispersion of the reducing agent in which particles with a diameter of 0.3 to 1.0 μm accounted for 80% by weight.

Solid Particle Dispersion of Antifoggant

To 10 grams of tribromomethylphenylsulfone were added 1.5 grams of hydroxypropyl methyl cellulose and 88.5 grams of water. They were thoroughly agitated to form a slurry, which was allowed to stand for 3 hours. Theirs subsequent procedure was the same as in the preparation of the solid particle dispersion of the reducing agent, obtaining a solid particle dispersion of the antifoggant in which particles with a diameter of 0.3 to 1.0 μm accounted for 70% by weight.

Solid Particle Dispersion of Toner

To 10 grams of a toner I-2, I-3, I-6, I-9 or I-13 according to the invention were added 1.5 grams of hydroxypropyl methyl cellulose and 88.5 grams of water. They were thoroughly agitated to form a slurry, which was allowed to stand for 5 hours. The subsequent procedure was the same as in the preparation of the solid particle dispersion of the reducing agent, obtaining a solid particle dispersion of the toner in which particles with a diameter of 0.3 to 1.0 μm accounted for 60% by weight or more.

Solid Particle Dispersion of Development Accelerator

To 5 grams of 3,4-dihydro-4-oxo-1,2,3-benzotriazine were added 0.7 gram of hydroxypropyl methyl cellulose and 94.3 ml of water. They were thoroughly agitated to form a slurry, which was allowed to stand for 2 hours. The subsequent procedure was the same as in the preparation of the solid particle dispersion of the reducing agent, obtaining a solid particle dispersion of the development accelerator in which particles with a diameter of 0.4 to 1.0 μm accounted for 70% by weight.

Emulsion Layer Coatinrg Solution

An emulsion layer coating solution was prepared by adding the silver halide grains B (equivalent to 10 mol % of silver halide per mol of the organic acid silver) and the following polymer latex (as the binder) and components to the organic acid silver microcrystalline dispersion B (equivalent to 1 mol of silver).

| | | |
|---|---|---|
| LACSTAR 3307B SBR latex | 431 | g |
| 1,1-bis(2-hydroxy-3,5-dimethylphenyl)-3,5,5-trimethylhexane (solid particle dispersion) | 100 | g |
| Tribromomethylphenylsulfone (solid particle dispersion) | 21.8 | g |
| 3,4-dihydro-4-oxo-1,2,3-benzotriazine (solid particle dispersion) | 4.3 | g |

It is noted that the solid particle dispersion of tribromomethylphenylsulfone was omitted in coated sample No. 17.

Emulsion Surface Protective Layer Coating Solution

A surface protective layer coating solution was prepared by adding 0.26 gram of Surfactant A, 0.10 gram of Surfactant B, 1.0 gram of silica microparticulates having a mean particle size of 2.5 μm, 0.4 gram of 1,2-bis(vinylsulfonylacetamide)ethane, an amount as shown in Table 2 of the solid particle dispersion of the inventive toner, 65 mg of 4-methylphthalic acid, and 66 grams of water to 10 grams of inert gelatin. Another surface protective layer coating solution was prepared by adding phthalazine as a comparative toner. These solutions were used to form the surface protective layers of coated sample Nos. 9 to 20.

Surfactant A

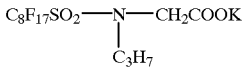

Surfactant B

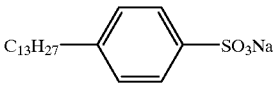

Decolorizable Dye Dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a decolorizable dye dispersion.

Compound 1

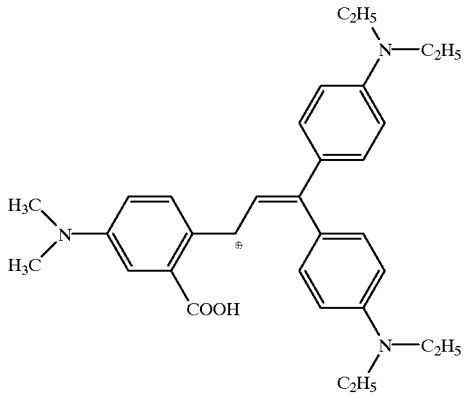

Compound 2

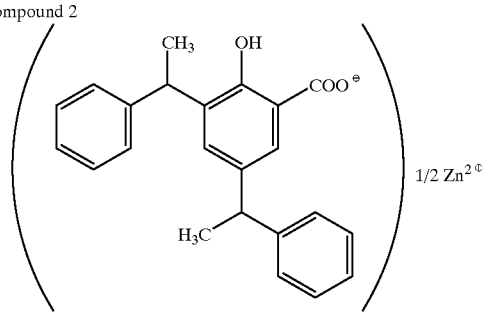

Back Surface Coating Solution

A back surface coating solution was prepared by adding 51 grams of the decolorizable dye dispersion, 20 grams of Compound 3, 250 grams of water, and 2.0 grams of spherical silica Sildex H121 (mean size 12 μm) to 30 grams of polyvinyl alcohol.

Compound 3

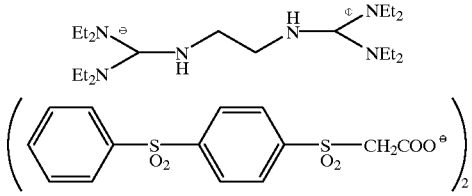

Coated Sample

The support used was a polyethylene terephthalate (PET) film of 175 μm thick tinted with a blue dyestuff. Onto one surface of the PET film, the emulsion layer coating solution and the surface protective layer coating solution, both prepared above, were concurrently applied in an overlapping manner to form an emulsion layer and a protective layer thereon so as to provide a silver coverage of 1.8 g/m$^2$ and a gelatin coverage of 1.8 g/m$^2$, respectively. After drying, the back layer coating solution was coated on the opposite surface of the film so as to provide an optical density of 0.7 at 650 nm. A series of coated samples, Nos. 9 to 20, were obtained in this way.

Photograhic Test

The photographic material was exposed to light at an angle of 30° relative to a normal to the material surface by means of a 647-nm Kr laser sensitometer (maximum power 500 mW) and developed by heating at 120° C. for 20 seconds. The resulting image was measured for fog, maximum density (Dmax) and sensitivity by means of a densitometer. The sensitivity (S) is the reciprocal of a ratio of the exposure providing a density of fog (Dmin)+1.0, and is expressed in a relative value based on a sensitivity of 100 for coated sample No. 10.

Storarge Stability Prior to Image Formation

Each coated sample was cut into sections of 30.5 cm×25.4 cm with round corners having an inner radius of 0.5 cm. Film sections were kept in an atmosphere of 25° C. and RH 50% for one day. Each sample sheet was placed in a moisture-proof bag, which was sealed and placed in a decorative box of 35.1 cm×26.9 cm×3.0 cm. In this condition, the sample was aged for 5 days at 50° C. (forced aging test). The aged sample was processed as in the photographic test and measured for fog, sensitivity (S) and maximum density (Dmax).

The results are shown in Table 2.

TABLE 2

| Coated sample | Toner Type | Toner Amount (mol/mol Ag) | Fresh sample photographic properties Fog | Fresh sample S | Fresh sample Dmax | Aged sample photographic properties Fog | Aged sample S | Aged sample Dmax |
|---|---|---|---|---|---|---|---|---|
| 9* | phthalazine | 0.03 | 0.09 | 98 | 3.1 | 0.05 | 10 | 1.2 |
| 10* | phthalazine | 0.06 | 0.1 | 100 | 3.2 | 0.07 | 32 | 1.45 |
| 11 | I-2 | 0.03 | 0.07 | 101 | 3.2 | 0.07 | 103 | 2.9 |
| 12 | I-2 | 0.06 | 0.08 | 105 | 3.2 | 0.07 | 107 | 3 |
| 13 | I-3 | 0.03 | 0.06 | 102 | 3.2 | 0.06 | 104 | 3 |
| 14 | I-3 | 0.06 | 0.07 | 107 | 3.3 | 0.07 | 110 | 3.1 |
| 15 | I-6 | 0.03 | 0.08 | 100 | 3 | 0.08 | 98 | 2.8 |
| 16 | I-6 | 0.06 | 0.09 | 101 | 3.1 | 0.1 | 100 | 2.9 |
| 17 | I-13 | 0.03 | 0.07 | 99 | 3 | 0.07 | 101 | 2.8 |
| 18 | I-13 | 0.06 | 0.07 | 101 | 3.1 | 0.08 | 102 | 3 |
| 19 | I-9 | 0.03 | 0.06 | 101 | 3.1 | 0.07 | 105 | 3 |
| 20 | I-9 | 0.06 | 0.07 | 103 | 3.2 | 0.07 | 106 | 3.1 |

*comparison

It is evident from Table 2 that surprisingly, photographic elements using the compounds or the invention produce images having a high density and maintain their photographic properties highly stable even after storage.

Examination of Volatility

The coated samples, Nos. 10 and 20, were stored for 3 days under conditions of 50° C. and RH 75%. The samples were then immersed in a solvent mixture of acetonitrile/water=9/1 whereupon ultrasonic agitation was effected for 30 minutes for film extraction. The quantitative determination of phthalazine or phthalazine derivative left in the photographic sample was carried out by high-speed liquid chromatography. The high-speed liquid chromatography used a solution of PIC-A (Waters Co.) adjusted to pH 7 with 1N phosphoric acid and Capsule Pack C18 Column (Shiseido K.K.). The results are shown below.

| Coated sample | Compound | Addition amount (mol/mol Ag) | Retention (%) |
|---|---|---|---|
| No. 10 | Phthalazine | 0.06 | 60 |
| No. 20 | Compound I-9 | 0.06 | >95 |

It is thus evident that the inventive compounds are well suppressed in volatility from within thermographic elements.

Example 3

Silver halide grains C were prepared by the same procedure as the preparation of silver halide grains B in Example 2 except that Sensitizing Dyes E and F were used instead of Sensitizing Dyes C and D. Silver halide grains C were used instead of silver halide grains B. Instead of the sensitometer used in the examination of phornographic properties in Example 1, a laser sensitometer equipped with a 820-nm diode was used for examining photographic properties, normal aging stability and image retention. Except for these, examination was made as in Example 2. It was found that the photographic properties of aged samples were significantly improved and the retention of image areas was significantly improved.

Sensitizing Dye E

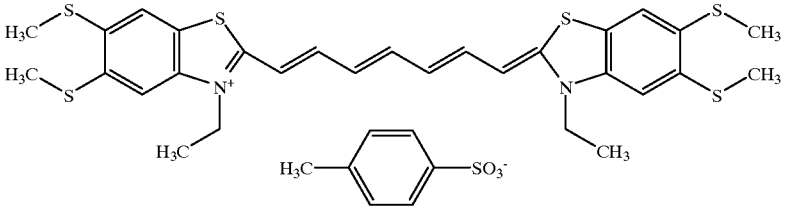

Sensitizing Dye F

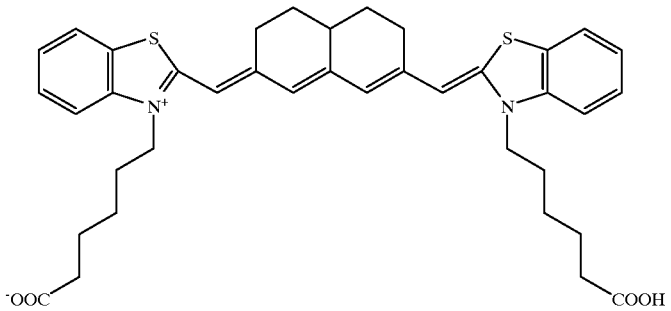

Owing to the use of the compounds of formula (I), thermographic photographic elements produce images having a high density and maintain their photographic properties stable during storage.

Example 4

Silver Halide Grains A

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing potassium bromide and 0.3 mg of $K_2IrCl_6$ were added over 30 minutes by the controlled double jet method while maintaining the solution at pAg 7.7. The pH of the solution was lowered to cause flocculation and sedimentation for desalting. After 0.1 gram of phenoxyethanol was added, the solution was adjusted to pH 5.9 and pAg 8.2. The solution was heated at 60° C., to which 85 μmol of sodium thiosulfate, 11 μmol of 2,3,4,5,6-pentafluorophenyldiphenylphosphine selenide, 15 μmol of Tellurium Compound 1, 3.3 μmol of chloroauric acid, and 250 μmol of thiocyanic acid were added per mol of silver. The solution was ripened for 120 minutes while stirring, and quenched to 30° C., completing the preparation of silver iodobromide grains A having a silver iodide content of 8 mol % in the core and 2 mol % on the average and an iridium content of $1.4\times10^{-6}$ mol/mol of Ag. The grains had a mean grain size of 0.08 μm, a coefficient of variation of projected area diameter of 8%, and a {100} face proportion of 88%.

Tellurium Compound 1

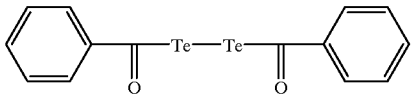

Organic Fatty Acid Silver Emulsion A

While a mixture of 8 grams of stearic acid, 3 grams of arachidic acid, 36 grams of behenic acid, and 860 ml of distilled water was vigorously stirred at 90° C., 187 ml of 1N NaOH aqueous solution was added and the mixture was allowed to react for 60 minutes. Then 65 ml of 1N nitric acid was added and the mixture was cooled to 50° C. The above-prepared silver halide grains A were added to this in such an amount as to give 6.2 mmol of silver halide. Further, 125 ml of an aqueous solution containing 21 grams of silver nitrate was added over 100 seconds and stirring was continued for 10 minutes. Thereafter, 1.24 grams of N-bromosuccinimide was added to the mixture, which was allowed to stand for 10 minutes and then cooled below 30° C. With stirring, 150 grams of butyl acetate was added to the thus prepared aqueous mixture, which was further stirred for extracting all the organic fatty acid silver salt into the butyl acetate phase. The aqueous phase was removed together with the salt contained therein. The butyl acetate phase was further desalted and dewatered until the water finally removed therefrom reached a conductivity of 50 μS/cm. To this, 80 grams of a 2.5 wt % 2-butanone solution of polyvinyl butyral (Denka Butyral #3000-K) was added, followed by agitation. Furthermore, 200 grams of 2-butanone and 59 grams of polyvinyl butyral (BUTVAR® B-76) were added. The mixture was dispersed for 80 minutes by means of a homogenizer. Pyridinium hydrobromide perbromide (PHP), 0.5 mmol, was added to the mixture, which was agitated for 30 minutes, completing the preparation of organic fatty acid silver A.

Emulsion layer coating solution

An emulsion layer coating solution was prepared by adding various chemicals to the above-prepared organic fatty acid silver A in amounts per mol of silver.

| | | |
|---|---|---|
| $CaBr_2$ | 6.5 | mmol |
| 2-mercapto-5-methylbenzimidazole | 7.65 | mmol |
| Sensitizing dye A | 0.6 | mmol |
| 1,1-bis(2-hydroxy-3,5-dimethylphenyl)-3,5,5-trimethylhexane | 0.27 | mol |
| 2-tribromomethylsulfonylbenzothiazole | 24.2 | mmol |
| Inventive toner | (see Table 3) | |
| Comparative compound (phthalazine) | (see Table 3) | |
| Sumidur N3500 isocyanate | 3.6 | g |

Sensitizing dye A

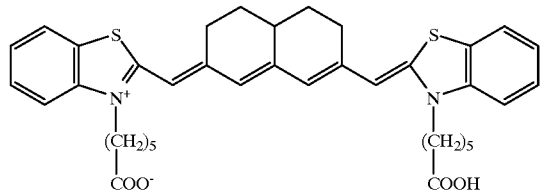

Surface Protective Layer Coating Solution

A surface protective layer coating solution was prepared by mixing the following components.

| | | |
|---|---|---|
| Cellulose acetate butyrate | 7.6 | g |
| 2-butanone | 80 | g |
| Methanol | 10 | g |
| 4,6-ditrichloromethyl-2-phenyltriazine | 0.07 | g |
| Megafax F-176P fluorinated surfactant | 2.6 | g |
| Inventive organic acid compound | (see Table 3) | |

Back layer coating solution

A back layer coating solution was prepared by mixing the following components.

| | | |
|---|---|---|
| Polyvinyl butyral (10 wt % in 2-butanone) | 150 | ml |
| Antihalation Dye 1 | 0.05 | g |
| Megafax F-176P fluorinated surfactant | 0.5 | g |
| Sildex H121 spherical silica (12 μm) | 0.4 | g |
| Sildex H51 spherical silica (5 μm) | 0.4 | g |

Antihalation Dye 1

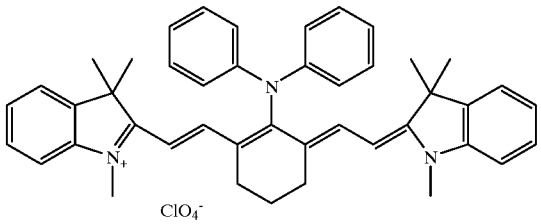

Coated Sample

Onto one surface of a biaxially oriented polyethylene terephthalate (PET) film of 175 μm thick tinted blue, the back layer coating solution was coated so as to provide an absorbance at 810 nm which was higher by 1.2 than the absorbance of the PET film. The emulsion layer coating solution prepared above was coated on the opposite surface of the PET film so as to provide a silver coverage of 1.8 g/m$^2$. After drying, the surface protective layer coating solution was coated onto the emulsion layer so as to provide a cellulose acetate butyrate coverage of 2.5 g/m$^2$. A series of coated samples, Nos. 201 to 214, were obtained in this way (see Table 3).

Photorgraphic Properties

Coated sample Nos. 201 to 214 were exposed imagewise using a modified model of FCR7000 (Fuji Photo Film Co., Ltd.) equipped with a semiconductor laser at 810 nm. The angle between the laser beam and the surface of the coated sample exposed thereto was 80 degrees. The exposed samples were developed by uniformly heating at 120° C. for 20 seconds. The thus formed images were examined for sensitivity and fog by means of a densitometer. The sensitivity (S) is the reciprocal of a ratio of the exposure providing a density equal to the fog (Dmin)+1.0, and is expressed in a relative value based on a sensitivity of 100 for coated sample No. 203. The fog was the measurement minus the base density.

Storage Stability Prior to Image Formation

The coated samples were stored in a warm humid atmosphere (35° C., RH 60%) for 5 days. The aged samples were similarly examined for photographic properties for evaluating the stability of photographic properties against aging.

Image Stability Subsequent to Image Formation

The samples which had been examined for photographic properties were left to stand for 5 days in a warm humid light-irradiated place (35° C., RH 60%, light of 1,000 lux at maximum) and then visually observed to examine any change of the fogged portion. Evaluation was made according to the following criteria.

⊙: substantially unchanged

○: slightly discolored, but inoffensive

Δ: discolored, but practically acceptable

X: markedly discolored, unacceptable

The results are shown in Table 3.

TABLE 3

| Coated sample | Toner Type | Toner Amount (mol/mol Ag) | Organic acid compound Type | Organic acid compound Amount (mol/mol Ag) | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|---|---|---|---|
| 201* | phthalazine | 0.04 | — | — | 0.05 | — | 0.16 | 0.05 | — | 0.07 | X |
| 202* | phthalazine | 0.07 | — | — | 0.05 | — | 0.16 | 0.05 | — | 0.08 | X |
| 203* | phthalazine | 0.04 | II-3 | 0.04 | 0.07 | 100 | 3.2 | 0.06 | 35 | 1.30 | X |
| 204* | phthalazine | 0.07 | II-3 | 0.07 | 0.09 | 110 | 3.2 | 0.06 | 52 | 1.40 | X |
| 205 | I-1-7 | 0.04 | II-3 | 0.04 | 0.07 | 100 | 3.2 | 0.08 | 95 | 2.7 | ○ |
| 206 | I-1-7 | 0.07 | II-3 | 0.07 | 0.08 | 105 | 3.2 | 0.09 | 106 | 2.8 | ○ |
| 207 | I-1-10 | 0.04 | II-3 | 0.04 | 0.07 | 101 | 3.1 | 0.07 | 100 | 3.1 | ⊙ |
| 208 | I-1-10 | 0.07 | II-3 | 0.07 | 0.08 | 103 | 3.2 | 0.08 | 108 | 3.2 | ⊙ |
| 209* | I-1-10 | 0.04 | — | — | 0.05 | — | 0.15 | 0.05 | — | 0.13 | ○ |
| 210* | I-1-10 | 0.07 | — | — | 0.05 | — | 0.18 | 0.05 | — | 0.16 | ○ |
| 211 | I-1-14 | 0.04 | II-3 | 0.04 | 0.07 | 104 | 3.2 | 0.07 | 105 | 2.8 | ○ |
| 212 | I-1-14 | 0.07 | II-3 | 0.07 | 0.08 | 115 | 3.2 | 0.08 | 120 | 2.8 | ○ |
| 213 | I-1-16 | 0.04 | II-3 | 0.04 | 0.07 | 101 | 3.2 | 0.07 | 102 | 3.2 | ⊙ |
| 214 | I-1-16 | 0.07 | II-3 | 0.07 | 0.08 | 108 | 3.2 | 0.08 | 110 | 3.2 | ⊙ |

*comparison

It is evident from Table 3 that surprisingly, photographic elements using the compounds of the invention produce images having a high density and maintain their photographic properties highly stable during the storage under warm humid conditions prior to the image formation process. Furthermore, quite unexpectedly, they are also significantly improved in image retention subsequent to image formation.

Example 5

Silver Halide Grains B

In 700 ml of water were dissolved 24 grams of phthalated gelatin and 30 mg of potassium bromide. The solution was adjusted to pH 5.0 at a temperature of 40° C. To the solution, 159 ml of an aqueous solution containing 18.7 grams of silver nitrate and an aqueous solution containing potassium bromide and potassium iodide in a molar ratio of 92:8 were added over 10 minutes by the controlled double jet method while maintaining the solution at pAg 7.8. Then, 476 ml of an aqueous solution containing 55.4 grams of silver nitrate and an aqueous solution containing 7 μmol/liter of dipotassium hexachloroiridate and 1 mol/liter of potassium bromide were added over 30 minutes by the controlled double jet method while maintaining the solution at pAg 7.6. Then, the pH of the solution was lowered to cause flocculation and sedimentation for desalting. With 0.2 gram of phenoxyethanol added, the solution was adjusted to pH 5.9 and pAg 8.0. There were obtained cubic grains having a silver iodide content of 8 mol % in the core and 2 mol % on the average, a mean grain size of 0.07 μm, a coefficient of variation of the projected area diameter of 10%, and a (100) face proportion of 85%.

The thus obtained silver halide grains B were heated at 60° C., to which 85 μmol of sodium thiosulfate, 6 μmol of 2,3,4,5,6-pentafluorophenyldiphenylphosphine selenide, 1.7 μmol of Tellurium Compound 1 (used in Example 4), 3.9 μmol of chloroauric acid, and 220 μmol of thiocyanic acid were added per mol of silver. The emulsion was ripened for 120 minutes and then cooled to 50° C. With stirring, $5\times10^{-4}$ mol of Sensitizing Dye C and $2\times10^{-4}$ mol of Sensitizing Dye D were added to this per mol of silver halide. Moreover, 3.7 mol % based on the silver of potassium iodide was added to the emulsion, which was agitated for 30 minutes and then quenched to 30° C., completing the preparation of silver halide grains B.

Sensitizing Dye C

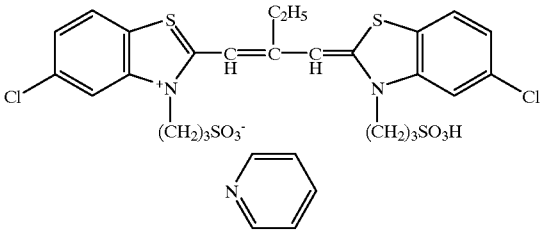

Sensitizing Dye D

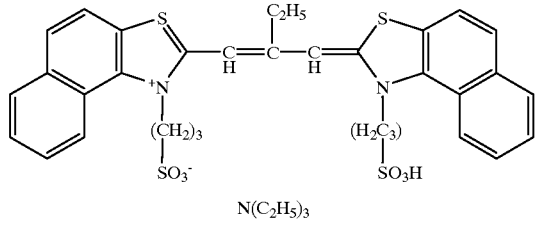

Organic Acid Silver Microcrystalline Dispersion B

A mixture of 40 grams of behenic acid, 7.3 grams of stearic acid, and 500 ml of distilled water was stirred at 90° C. for 20 minutes, 187 ml of a 1N NaOH aqueous solution was added over 15 minutes, then 61 ml of a 1N nitric acid aqueous solution was added. The resulting solution was cooled to 50° C. Then 124 ml of a 1N silver nitrate aqueous solution was added over 2 minutes, and stirring was continued for 40 minutes. Thereafter, the solids were separated by centrifugation and washed with water until the water filtrate reached a conductivity of 30 μS/cm. The thus obtained solids were handled as a wet cake without drying. To 33.4 grams as dry solids of the wet cake were added 12 grams of polyvinyl alcohol and 150 ml of water. They were thoroughly mixed to form a slurry. The slurry was admitted into a dispersing machine Micro-Fluidizer M-110-E/H (manufactured by Microfluidex Corporation, wall impact type chamber). The machine was operated for dispersion under an impact pressure of 500 kg/cm$^2$. There was obtained a microcrystalline dispersion B of needle grains of organic acid silver having a mean minor diameter of 0.04 μm, a mean major diameter of 0.8 μm and a coefficient of variation of the projected area of 35% as determined by electron microscopic observation.

Solid Particle Dispersion of Reducing Agent

To 10 grams of 1,1-bis(2-hydroxy-3,5-dimethylphenyl)-3,5,5-trimethylhexane were added 1.5 grams of hydroxypropyl methyl cellulose and 88.5 ml of water. They were thoroughly agitated to form a slurry, which was allowed to stand for 3 hours. A vessel was charged with the slurry together with 360 grams of zirconia beads having a mean diameter of 0.5 mm. A dispersing machine 1/4G Sand Grinder Mill (manufactured by Imex K.K.) was operated for 3 hours for dispersion, obtaining a solid particle dispersion of the reducing agent in which particles with a diameter of 0.3 to 1.0 μm accounted for 80% by weight.

Solid Particle Dispersion of Antifoggant

To 10 grams of tribromomethylphenylsulf:one were added 1.5 grams of hydroxypropyl methyl cellulose and 88.5 grams of water. They were thoroughly agitated to form a slurry, which was allowed to stand for 3 hours. The subsequent procedure was the same as in the preparation of the solid particle dispersion of the reducing agent, obtaining a solid particle dispersion of the antifoggant in which particles with a diameter of 0.3 to 1.0 μm accounted for 70% by weight.

Solid Particle Dispersions of Toner and Organic Acid Compound

To 10 grams of toner I-1-10, I-1-14 or I-1-16 or 10 grams of organic acid compound II-1, II-3, II-5, II-15 or II-22 according to the invention were added 1.5 grams of hydroxypropyl methyl cellulose and 88.5 grams of water. They were thoroughly agitated to form a slurry, which was allowed to stand for 5 hours. The subsequent procedure was the same as in the preparation of the solid particle dispersion of the reducing agent, obtaining a solid particle dispersion of the toner or organic acid compound in which particles with a diameter of 0.3 to 1.0 μm accounted for 60% by weight or more.

Solid Particle Dispersion of Development Accelerator

To 5 grams of 3,4-dihydro-4-oxo-1,2,3-benzotriazine were added 0.7 gram of hydroxypropyl methyl cellulose and 94.3 ml of water. They were thoroughly agitated to form a slurry, which was allowed to stand for 2 hours. The subsequent procedure was the same as in the preparation of the solid particle dispersion of the reducing agent, obtaining a solid particle dispersion of the development accelerator in which particles with a diameter of 0.4 to 1.0 μm accounted for 70% by weight.

Emulsion Layer Coating Solution

An emulsion layer coating solution was prepared by adding the silver halide grains B (equivalent to 10 mol % of silver halide per mol of the organic acid silver) and the following polymer latex (as the binder) and components to the organic acid silver microcrystalline dispersion B (equivalent to 1 mol of silver).

| | | |
|---|---|---|
| LACSTAR 3307B SBR latex | 431 | g |
| 1,1-bis(2-hydroxy-3,5-dimethylphenyl)-3,5,5-trimethylhexane (solid particle dispersion) | 92 | g |
| Tribromomethylphenylsulfone (solid particle dispersion) | 21.8 | g |
| 3,4-dihydro-4-oxo-1,2,3-benzotriazine (solid particle dispersion) | 4.3 | g |

Emulsion Surface Protective Layer Coating Solution

A surface protective layer coating solution was prepared by adding 0.26 gram of Surfactant A, 0.10 gram of Surfactant B, 1.0 gram of silica microparticulates having a mean particle size of 2.5 μm, 0.4 gram of 1,2-bis (vinylsulfonylacetamide)ethane, an amount as shown in Table 4 of the solid particle dispersion of the inventive toner, an amount as shown in Table 4 of the solid particle dispersion of the inventive organic acid compound, and 66 grams of water to 10 grams of inert gelatin. Another surface protective layer coating solution was prepared by adding phthalazine as a comparative toner. These solutions were used to form the surface protective layers of coated sample Nos. 221 to 232.

Surfactant A

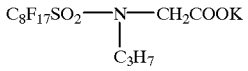

Surfactant B

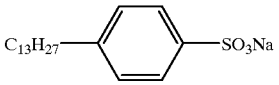

Decolorizable Dye Dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a decolorizable dye dispersion.

Compound 1

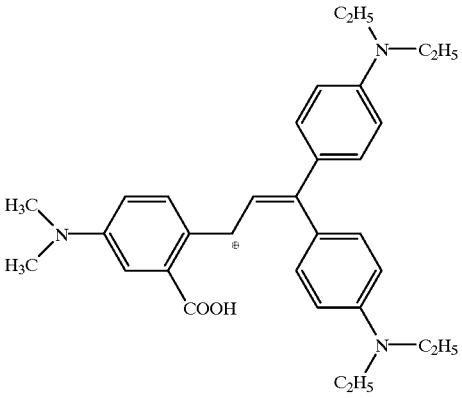

-continued

Compound 2

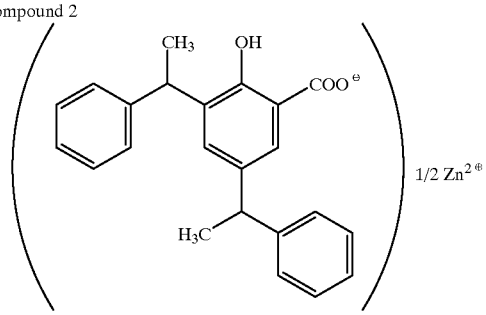

Back Surface Coating Solution

A back surface coating solution was prepared by adding 51 grams of the decolorizable dye dispersion, 20 grams of Compound 3, 250 grams of water, and 2.0 grams of spherical silica Sildex H121 (mean size 12 μm) to 30 grams of polyvinyl alcohol.

Compound 3

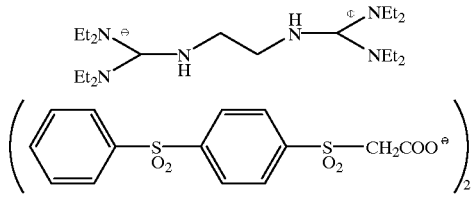

Coated Sample

The support used was a polyethylene terephthalate (PET) film of 175 μm thick tinted with a blue dyestuff. Onto one surface of the PET film, the emulsion layer coating solution and the surface protective layer coating solution, both prepared above, were concurrently applied in an overlapping manner to form an emulsion layer and a protective layer thereon so as to provide a silver coverage of 1.8 g/m$^2$ and a gelatin coverage of 1.8 g/m$^2$, respectively. After drying, the back layer coating solution was coated on the opposite surface of the film so as to provide an optical density of 0.7 at 650 nm. A series of coated samples, Nos. 221 to 232, were obtained in this way.

Photorgrarphic Test

The photographic material was exposed to light at an angle of 30° relative to a normal to the material surface by means of a 647-nm Kr laser sensitometer (maximum power 500 mW) and developed by heating at 120° C. for 20 seconds. The resulting image was measured for fog, maximum density (Dmax) and sensitivity by means of a densitometer. The sensitivity (S) is the reciprocal of a ratio of the exporsure providing a density of fog (Dmin)+1.0, and is expressed in a relative value based on a sensitivity of 100 for coated sample No. 222.

Storage Stability Prior to Image Formation

Each coated sample was cut into sections of 30.5 cm×25.4 cm with round corners having an inner radius of 0.5 cm. Film sections were kept in an atmosphere of 25° C. and RH 50% for one day. Each sample sheet was placed in a moisture-proof bag, which was sealed and placed in a decorative box of 35.1 cm×26.9 cm×3.0 cm. In this condition, the sample was aged for 5 days at 50° C. (forced aging test). The aged sample was processed as in the photographic test and measured for fog, sensitivity (S) and maximum density (Dmax).

Image Stability Subsequent to Image Formation

The image formed samples were tested as in Example 4. The results are shown in Table 4.

TABLE 4

| Coated sample | Toner Type | Toner Amount (mol/mol Ag) | Organic acid compound Type | Organic acid compound Amount (mol/mol Ag) | Organic acid compound Type | Organic acid compound Amount (mol/mol Ag) |
|---|---|---|---|---|---|---|
| 221* | phthalazine | 0.06 | — | — | — | — |
| 222* | phthalazine | 0.06 | II-22 | 0.06 | — | — |
| 223* | I-1-16 | 0.06 | — | — | — | — |
| 224 | I-1-16 | 0.06 | II-22 | 0.06 | — | — |
| 225 | I-1-16 | 0.06 | II-22 | 0.06 | II-1 | 0.02 |
| 226 | I-1-16 | 0.06 | II-22 | 0.06 | II-5 | 0.02 |
| 227 | I-1-16 | 0.06 | II-22 | 0.06 | II-15 | 0.02 |
| 228 | I-1-10 | 0.06 | II-3 | 0.06 | II-15 | 0.02 |
| 229 | I-1-14 | 0.03 | II-3 | 0.06 | II-15 | 0.02 |
| 230 | I-1-14 | 0.06 | II-3 | 0.06 | II-15 | 0.02 |
| 231 | I-1-14 | 0.10 | II-3 | 0.06 | II-15 | 0.02 |
| 232 | I-1-14 | 0.18 | II-3 | 0.06 | II-15 | 0.02 |

| Coated sample | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|
| 221* | 0.03 | — | 0.10 | 0.02 | — | 0.10 | X |
| 222* | 0.07 | 100 | 3.10 | 0.04 | 3 | 1.15 | X |
| 223* | 0.03 | — | 0.15 | 0.03 | — | 0.15 | ○ |
| 224 | 0.06 | 103 | 3.15 | 0.06 | 101 | 2.50 | ○ |
| 225 | 0.05 | 110 | 3.20 | 0.07 | 105 | 3.10 | ◎ |
| 226 | 0.05 | 103 | 3.20 | 0.06 | 106 | 3.15 | ◎ |
| 227 | 0.05 | 95 | 3.20 | 0.05 | 101 | 3.10 | ◎ |
| 228 | 0.05 | 98 | 3.10 | 0.06 | 99 | 3.05 | ◎ |
| 229 | 0.06 | 94 | 3.10 | 0.06 | 97 | 2.70 | Δ |
| 230 | 0.06 | 99 | 3.15 | 0.06 | 103 | 2.75 | ○ |
| 231 | 0.05 | 106 | 3.15 | 0.05 | 111 | 2.65 | ○ |
| 232 | 0.05 | 113 | 3.20 | 0.05 | 115 | 2.85 | ○ |

*comparison

It is evident from Table 4 that surprisingly, photographic elements using the compounds of the invention produce images having a high density and maintain their photographic properties highly stable during storage. Furthermore, quite unexpectedly, they are also significantly improved in image retention subsequent to image formation. The performance as an image forming element is significantly improved.

Example 6

Solid Particle Dispersion of Toner

To 10 grams of toner I-1-7, I-1-13, 1-1-16, I-1-20 or I-1-34 according to the invention were added 4 grams of hydroxypropyl methyl cellulose and 86 grams of water. They were thoroughly agitated to form a slurry, which was allowed to stand for 10 hours. The subsequent procedure was the same as in the preparation of the solid particle dispersion of the inventive compound I-16 in Example 5, obtaining a solid particle dispersion of the toner. The particle size was the same as in the solid particle dispersion of the inventive compound I-16.

Solid Particle Dispersion of Organic Acid Compound

A solid particle dispersion of organic acid compound II-2 according to the invention was prepared by the same procedure as the dispersion of compound II-1 in Example 5. The particle size was the same as in the dispersion of compound II-1.

Coated Sample

Coated samples were prepared by the same procedure as coated sample No. 226 in Example 5 except that the solid particle dispersion of toner I-1-7, I-1-13, I-1-16, I-1-20 or I-1-34 according to the invention and the solid particle dispersion of organic acid compound II-2 according to the invention were added to the emulsion surface protective layer coating solution in amounts per mol of the organic acid silver as shown in Table 5.

The coated samples were tested as in Example 5, with the results shown in Table 5.

TABLE 5

| Coated sample | Toner Type | Toner Amount (mol/mol Ag) | Organic acid compound Type | Organic acid compound Amount (mol/mol Ag) | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|---|---|---|---|
| 241* | phthalazine | 0.05 | II-2 | 0.05 | 0.10 | 100 | 3.1 | 0.13 | 41 | 1.7 | X |
| 242 | I-1-7 | 0.05 | II-2 | 0.05 | 0.10 | 99 | 3.0 | 0.11 | 101 | 2.5 | Δ |

TABLE 5-continued

| Coated sample | Toner Type | Toner Amount (mol/mol Ag) | Organic acid compound Type | Organic acid compound Amount (mol/mol Ag) | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|---|---|---|---|
| 243 | I-1-13 | 0.05 | II-2 | 0.05 | 0.11 | 105 | 3.0 | 0.12 | 108 | 2.7 | ○ |
| 244 | I-1-16 | 0.05 | II-2 | 0.05 | 0.10 | 104 | 3.2 | 0.11 | 107 | 3.2 | ◎ |
| 245 | I-1-20 | 0.05 | II-2 | 0.05 | 0.10 | 104 | 3.1 | 0.11 | 105 | 2.9 | ○ |
| 246 | I-1-34 | 0.05 | II-2 | 0.05 | 0.10 | 107 | 3.1 | 0.12 | 103 | 2.9 | ○ |

*comparison

The benefits of the invention are evident from Table 5.

Example 7

Silver halide grains C were prepared by the same procedure as the preparation of silver halide grains B in Example 5 except that Sensitizing Dyes E and F were used instead of Sensitizing Dyes C and D. Silver halide grains C were used instead of silver halide grains B. Instead of the sensitometer used in the examination of photographic properties in Example 4, a laser sensitometer equipped with a 820-nm diode was used for examining photographic properties, forced aging stability and image retention. Except for these, examination was made as in Example 5. It was found that according to the invention, the photographic properties of aged samples were significantly improved and the image areas were maintained significantly stable against aging.

Sensitizing Dye E

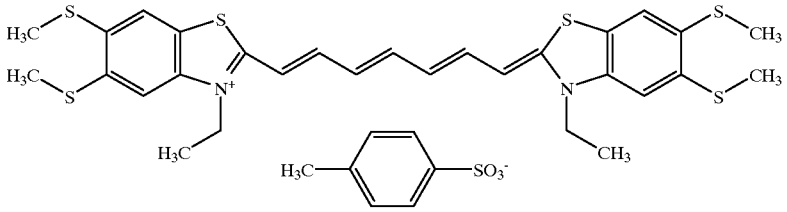

Sensitizing Dye F

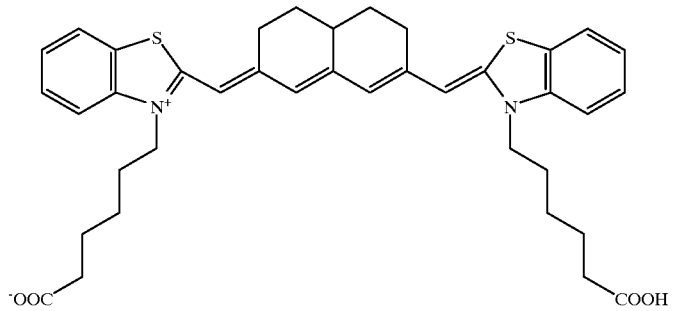

Owing to the combined use of the compounds of formulae (I-1) and (II), thermographic photographic elements experience a minimized drop of image density during storage prior to image formation and are improved in image retention.

Example 8

Silver Halide Grains A

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous resolution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing potassium bromide and 0.3 mg of $K_2IrCl_6$ were added over 30 minutes by the controlled double jet method while maintaining the solution at pAg 7.7. The pH of the solution was lowered to cause flocculation and sedimentation for desalting. After 0.1 gram of phenoxyethanol was added, the solution was adjusted to pH 5.9 and pAg 8.2. The solution was heated at 60° C., to which 85 μmol of sodium thiosulfate, 11 μmol of 2,3,4,5,6-pentafluorophenyldiphenylphosphine selenide, 15 μmol of Tellurium Compound 1, 3.3 μmol of chloroauric acid, and 250 μmol of thiocyanic acid were added per mol of silver. The solution was ripened for 120 minutes while stirring, and quenched to 30° C., completing the preparation of silver iodobromide grains A having a silver iodide content of 8 mol % in the core and 2 mol % on the average and an iridium content of $1.4\times10^{-6}$ mol/mol of Ag. The grains had a mean grain size of 0.08 μm, a coefficient of variation of projected area diameter of 8%, and a {100} face proportion of 88%.

Tellurium Compound 1

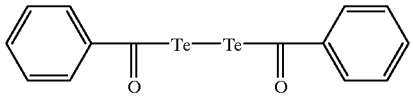

Organic Fatty Acid Silver Emulsion A

While a mixture of 7 grams of stearic acid, 4 grams of arachidic acid, 36 grams of behenic acid, and 850 ml of distilled water was vigorously stirred at 90° C., 187 ml of 1N NaOH aqueous solution was added and the mixture was allowed to react for 60 minutes. Then 65 ml of 1N nitric acid was added and the mixture was cooled to 50° C. The above-prepared silver halide grains A were added to this in such an amount as to give 6.2 mmol of silver halide. Further, 125 ml of an aqueous solution containing 21 grams of silver nitrate was added over 100 seconds and stirring was continued for 10 minutes. Thereafter, 1.24 grams of N-bromosuccinimide was added to the mixture, which was allowed to stand for 10 minutes and then cooled below 30° C. With stirring, 150 grams of butyl acetate was added to the thus prepared aqueous mixture, which was further stirred for extracting all the organic fatty acid silver salt into the butyl acetate phase. The aqueous phase was removed together with the salt contained therein. The butyl acetate phase was further desalted and dewatered until the water finally removed therefrom reached a conductivity of 50 μS/cm. To this, 80 grams of a 2.5 wt % 2-butanone solution of polyvinyl butyral (Denka Butyral #3000-K) was added, followed by agitation. Furthermore, 200 grams of 2-butanone and 59 grams of polyvinyl butyral (BUTVAR® B-76) were added. The mixture was dispersed for 80 minutes by means of a homogenizer. Pyridinium hydrobromide perbromide (PHP), 0.5 mmol, was added to the mixture, which was agitated for 30 minutes, completing the preparation of organic fatty acid silver A.

Emulsion layer coating solution

An emulsion layer coating solution was prepared by adding various chemicals to the above-prepared organic fatty acid silver A in amounts per mol of silver.

| | |
|---|---|
| $CaBr_2$ | 6.5 mmol |
| 2-mercapto-5-methylbenzimidazole | 7.65 mmol |
| Sensitizing dye A | 0.5 mmol |
| 1,1-bis(2-hydroxy-3,5-dimethylphenyl)-3,5,5-trimethylhexane | 0.27 mol |
| Inventive antifoggant | (see Table 6) |
| Comparative antifoggant | (see Table 6) |
| 4-chlorobenzophenone-2-carboxylic acid | 53 mmol |
| Tetrachlorophthalic acid | 5.8 mmol |
| Inventive toner | (see Table 6) |
| Comparative toner (phthalazine) | (see Table 6) |
| Sumidur N3500 isocyanate | 3.7 g |

Sensitizing dye A

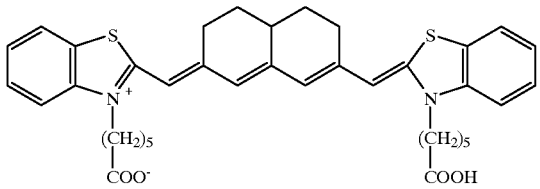

-continued

Comparative antifoggant

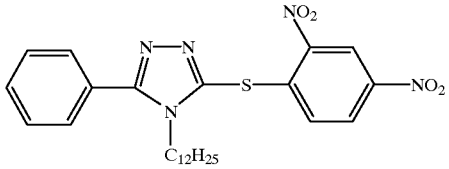

Surface Protective Layer Coating Solution

A surface protective layer coating solution was prepared by mixing the following components.

| | | |
|---|---|---|
| Cellulose acetate butyrate | 7.5 | g |
| 2-butanone | 80 | g |
| Methanol | 10 | g |
| 4-methylphthalic acid | 0.3 | g |
| 4,6-ditrichloromethyl-2-phenyltriazine | 0.07 | g |
| Megafax F-176P fluorinated surfactant | 2.5 | g |

Back Layer Coating Solution

A back layer coating solution was prepared by mixing the following components.

| | | |
|---|---|---|
| Polyvinyl butyral (10 wt % in 2-butanone) | 150 | ml |
| Antihalation Dye 1 | 0.05 | g |
| Megafax F-176P fluorinated surfactant | 0.5 | g |
| Sildex H121 spherical silica (12 μm) | 0.4 | g |
| Sildex H51 spherical silica (5 μm) | 0.4 | g |

Antihalation Dye 1

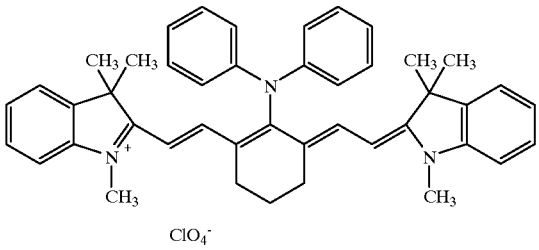

Coated Sample

Onto one surface of a biaxially oriented polyethylene terephthalate (PET) film of 175 μm thick tinted blue, the back layer coating solution was coated so as to provide an absorbance at 810 nm which was higher by 1.2 than the absorbance of the PET film. The emulsion layer coating solution prepared above was coated on the opposite surface of the PET film so as to provide a silver coverage of 1.8 $g/m^2$. After drying, the surface protective layer coating solution was coated onto the emulsion layer so as to provide a cellulose acetate butyrate coverage of 2.5 $g/m^2$. A series of coated samples, Nos. 301 to 318, were obtained in this way (see Table 6).

Photograhic Properties

Coated sample Nos. 301 to 318 were exposed imagewise using a modified model of FCR7000 (Fuji Photo Film Co., Ltd.) equipped with a semiconductor laser at; 810 nm. The angle between the laser beam and the surface of the coated sample exposed thereto was 80 degrees. The exposed samples were developed by uniformly heating at 120° C. for 20 seconds. The thus formed images were examined for sensitivity and fog by means of a densitometer. The sensitivity (S) is the reciprocal of a ratio of the exposure providing a density equal to the fog (Dmin)+1.0, and is expressed in a relative value based on a sensitivity of 100 for coated sample No. 303. The fog was the measurement minus the base density.

Storage Stability Prior to Image Formation

The coated samples were stored in a warm humid atmosphere (35° C., RH 60%) for 5 days. The aged samples were similarly examined for photographic properties for evaluating the stability of photographic properties against aging.

Image Stability Subsequent to Image Formation

The samples which had been examined for photographic properties were left to stand for 5 days in a warm humid light-irradiated place (35° C., RH 60%, light of 1,000 lux at maximum) and then visually observed to examine any change of the fogged portion. Evaluation was made according to the following criteria.

◎: substantially unchanged

○: slightly discolored, but inoffensive

Δ: discolored, but practically acceptable

X: markedly discolored, unacceptable

The results are shown in Table 6.

Example 9

Silver Halide Grains B

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.8. Then, 476 ml of an aqueous solution containing 55.4 grams of silver nitrate and an aqueous solution containing 6 μmol/liter of dipotassium hexachloroiridate and 1 mol/liter of potassium bromide were added over 30 minutes by the controlled double jet method while maintaining the solution at pAg 7.6. Then, the pH of the solution was lowered to cause flocculation and sedimentation for desalting. With 0.2 gram of phenoxyethanol added, the solution was adjusted to pH 5.9 and pAg 8.0. There were obtained cubic grains having a silver iodide content of 8 mol % in the core and 2 mol % on the average, a mean grain size of 0.07 μm, a coefficient of variation of the projected area diameter of 9%, and a (100) face proportion of 85%.

TABLE 6

| Coated sample | Toner Type | Toner Amount (mol/mol Ag) | Antifoggant Type | Antifoggant Amount (mol/mol Ag) | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|---|---|---|---|
| 301* | phthalazine | 0.08 | — | — | 1.20 | 118 | 3.4 | 0.7 | — | 0.8 | X |
| 302* | phthalazine | 0.08 | Comparative antifoggant | 0.025 | 0.11 | 48 | 3.0 | 0.22 | — | 0.9 | X |
| 303* | phthalazine | 0.04 | III-2 | 0.025 | 0.07 | 100 | 3.2 | 0.10 | — | 0.9 | X |
| 304* | phthalazine | 0.08 | III-2 | 0.025 | 0.09 | 103 | 3.3 | 0.01 | 7 | 1.2 | X |
| 305* | I-1-3 | 0.08 | — | — | 1.35 | 110 | 3.0 | 1.86 | 10 | 2.9 | X |
| 306* | I-1-3 | 0.08 | Comparative antifoggant | 0.025 | 0.18 | 46 | 3.3 | 0.25 | 63 | 3.2 | X |
| 307 | I-1-3 | 0.04 | III-2 | 0.025 | 0.06 | 103 | 3.4 | 0.09 | 102 | 3.2 | ○ |
| 308 | I-1-3 | 0.08 | III-2 | 0.025 | 0.08 | 109 | 3.4 | 0.10 | 106 | 3.2 | ◎ |
| 309 | I-1-10 | 0.04 | III-2 | 0.025 | 0.06 | 104 | 3.4 | 0.09 | 105 | 3.3 | ○ |
| 310 | I-1-10 | 0.08 | III-2 | 0.025 | 0.08 | 114 | 3.5 | 0.10 | 108 | 3.4 | ◎ |
| 311 | I-1-14 | 0.04 | III-2 | 0.025 | 0.06 | 100 | 3.0 | 0.08 | 98 | 3.0 | Δ |
| 312 | I-1-14 | 0.08 | III-2 | 0.025 | 0.08 | 101 | 3.0 | 0.09 | 99 | 3.0 | ○ |
| 313 | I-1-16 | 0.04 | III-2 | 0.025 | 0.06 | 105 | 3.5 | 0.08 | 103 | 3.4 | ○ |
| 314 | I-1-16 | 0.08 | III-2 | 0.025 | 0.08 | 103 | 3.4 | 0.09 | 106 | 3.3 | ◎ |
| 315 | I-1-16 | 0.04 | III-6 | 0.025 | 0.06 | 103 | 3.3 | 0.08 | 101 | 3.2 | ○ |
| 316 | I-1-16 | 0.04 | III-11 | 0.025 | 0.06 | 101 | 3.3 | 0.08 | 105 | 3.2 | ○ |
| 317 | I-1-16 | 0.04 | III-21 | 0.025 | 0.06 | 97 | 3.3 | 0.08 | 101 | 3.2 | ○ |
| 318 | I-1-16 | 0.04 | III-35 | 0.025 | 0.06 | 108 | 3.3 | 0.08 | 102 | 3.2 | ○ |

*comparison

It is evident from Table 6 that photographic elements using the antifoggants of the invention produce images having a low fog. Surprisingly, photographic elements using the toners of the invention maintain their photographic properties highly stable during the storage under warm humid conditions prior to the image formation process. Furthermore, quite unexpectedly, due to the combined use of the antifoggants and toners according to the invention, the photographic elements are significantly improved in image retention subsequent to image formation. Among the toners according to the invention, compounds I-1-3, I-10, and I-1-16 are most effective.

The thus obtained silver halide grains B were heated at 60° C., to which 85 μmol of sodium thiosulfate, 6 μmol of 2,3,4,5,6-pentafluorophenyldiphenylphosphine selenide, 1.7 μmol of Tellurium Compound 1 (used in Example 8), 3.9 μmol of chloroauric acid, and 220 μmol of thiocyanic acid were added per mol of silver. The emulsion was ripened for 120 minutes and then cooled to 50° C. To this, $5\times10^{-4}$ mol of Sensitizing Dye C and $2\times10^{-4}$ mol of Sensitizing Dye D were added per mol of silver halide. Moreover, 3.7 mol % based on the silver of potassium iodide was added to the emulsion, which was agitated for 30 minutes and then quenched to 30° C., completing the preparation of silver halide grains B.

Sensitizing Dye C

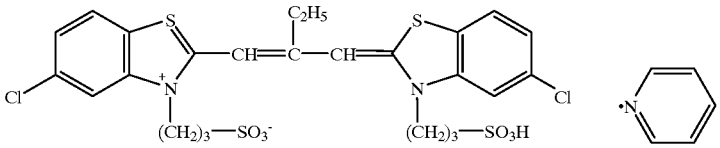

Sensitizing Dye D

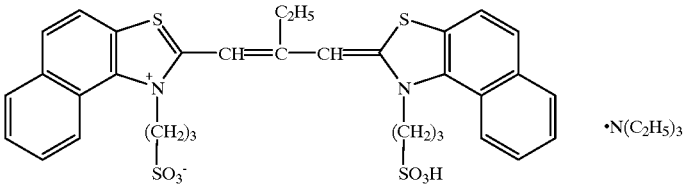

Organic Acid Silver Microcrystalline Dispersion B

A mixture of 40 grams of behenic acid, 7.3 grams of stearic acid, and 500 ml of distilled water was stirred at 90° C. for 20 minutes, 187 ml of a 1N NaOH aqueous solution was added over 15 minutes, then 61 ml of a 1N nitric acid aqueous solution was added. The resulting solution was cooled to 50° C. Then 124 ml of a 1N silver nitrate aqueous solution was added over 2 minutes, and stirring was continued for 40 minutes. Thereafter, the solids were separated by centrifugation and washed with water until the water filtrate reached a conductivity of 30 $\mu$S/cm. The thus obtained solids were handled as a wet cake without drying. To 33.4 grams as dry solids of the wet cake were added 12 grams of polyvinyl alcohol and 150 ml of water. They were thoroughly mixed to form a slurry. The slurry was admitted into a dispersing machine Micro-Fluidizer M-110-E/H (manufactured by Microfluidex Corporation, wall impact type chamber). The machine was operated for dispersion under an impact pressure of 500 kg/cm$^2$. There was obtained a microcrystalline dispersion B of needle grains of organic acid silver having a mean minor diameter of 0.04 $\mu$m, a mean major diameter of 0.8 $\mu$m and a coefficient of variation of the projected area of 35% as determined by electron microscopic observation.

Solid Particle Dispersion of Reducing Agent

To 10 grams of 1,1-bis(2-hydroxy-3,5-dimethylphenyl)-3,5,5-trimethylhexane were added 1.5 grams of hydroxypropyl methyl cellulose and 88.5 ml of water. They were thoroughly agitated to form a slurry, which was allowed to stand for 3 hours. A vessel was charged with the slurry together with 360 grams of zirconia beads having a mean diameter of 0.5 mm. A dispersing machine 1/4G Sand Grinder mill (manufactured by Imex K.K.) was operated for 3 hours for dispersion, obtaining a solid particle dispersion of the reducing agent in which particles with a diameter of 0.3 to 1.0 $\mu$m accounted for 80% by weight.

Solid Particle Dispersion of Antifoggant

To 10 grams of compound II-2, II-3 or II-24 according to the invention or Comparative Antifoggant were added 1.5 grams of hydroxypropyl methyl cellulose and 88.5 grams of water. They were thoroughly agitated to form a slurry, which was allowed to stand for 3 hours. The subsequent procedure was the same as in the preparation of the solid particle dispersion of the reducing agent, obtaining a solid particle dispersion of the antifoggant in which particles with a diameter of 0.3 to 1.0 $\mu$m accounted for 70% by weight.

Solid Particle Dispersion of Toner

To 10 grams of toner I-1-2, I-1-10, I-1-14 or I-1-16 according to the invention were added 1.5 grams of hydroxypropyl methyl cellulose and 88.5 grams of water. They were thoroughly agitated to form a slurry, which was allowed to stand for 5 hours. The subsequent procedure was the same as in the preparation of the solid particle dispersion of the reducing agent, obtaining a solid particle dispersion of the toner in which particles with a diameter of 0.3 to 1.0 $\mu$m accounted for 60% by weight or more.

Solid Particle Dispersion of Development Accelerator

To 5 grams of 3,4-dihydro-4-oxo-1,2,3-benzotriazine were added 0.7 gram of hydroxypropyl methyl cellulose and 94.3 ml of water. They were thoroughly agitated to form a slurry, which was allowed to stand for 2 hours. The subsequent procedure was the same as in the preparation of the solid particle dispersion of the reducing agent, obtaining a solid particle dispersion of the development accelerator in which particles with a diameter of 0.4 to 1.0 $\mu$m accounted for 70% by weight.

Emulsion Layer Coating Solution

An emulsion layer coating solution was prepared by adding the silver halide grains B (equivalent to 10 mol % of silver halide per mol of the organic acid silver) and the following polymer latex (as the binder) and components to the organic acid silver microcrystalline dispersion B (equivalent to 1 mol of silver).

| | |
|---|---|
| LACSTAR 3307B SBR latex | 431 g |
| 1,1-bis(2-hydroxy-3,5-dimethylphenyl)-3,5,5-trimethylhexane (solid particle dispersion) | 94 g |
| Inventive antifoggant (solid particle dispersion) | (see Table 7) |
| Comparative antifoggant (solid particle dispersion) | (see Table 7) |
| 3,4-dihydro-4-oxo-1,2,3-benzotriazine (solid particle dispersion) | 4.6 g |

Emulsion Surface Protective Layer Coating Solution

A surface protective layer coating solution was prepared by adding 0.26 gram of Surfactant A, 0.10 gram of Surfactant B, 1.0 gram of silica microparticulates having a mean particle size of 2.5 $\mu$m, 0.4 gram of 1,2-bis(vinylsulfonylacetamide)ethane, an amount as shown in Table 7 of the solid particle dispersion of the inventive toner when used, and 66 grams of water to 10 grams of inert gelatin. Another surface protective layer coating solution was prepared by adding phthalazine as a comparative toner. These solutions were used to form the surface protective layers of coated sample Nos. 319 to 335.

Surfactant A

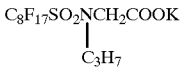

Surfactant B

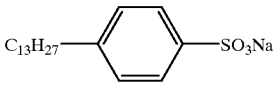

Decolorizable Dye Dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a decolorizable dye dispersion.

Compound 1

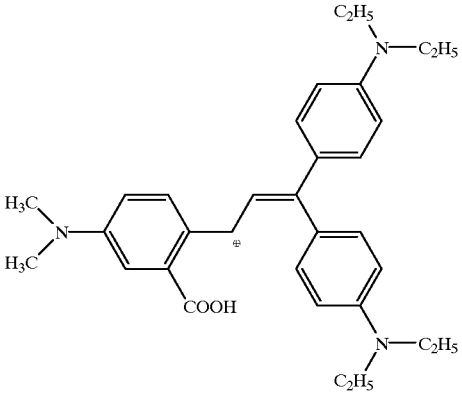

Compound 2

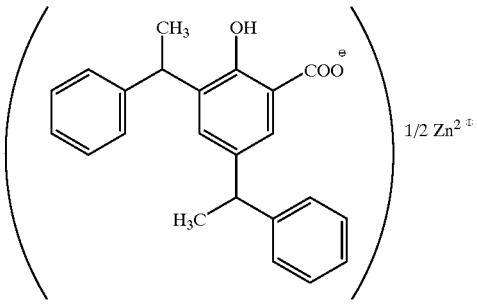

-continued

Compound 1

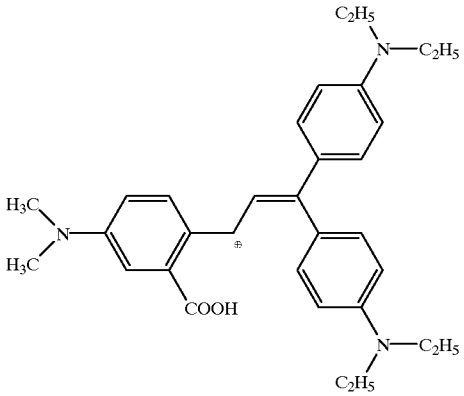

Compound 2

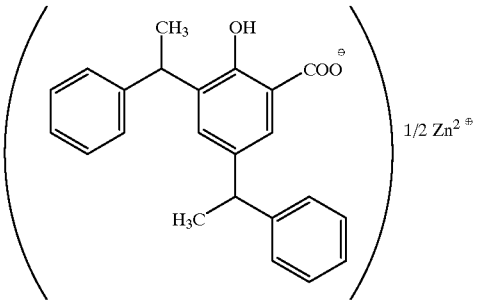

Back Surface Coating Solution

A back surface coating solution was prepared by adding 51 grams of the decolorizable dye dispersion, 20 grams of Compound 3, 250 grams of water, and 2.0 grams, of spherical silica Sildex H121 (mean size 12 μm) to 30 grams of polyvinyl alcohol.

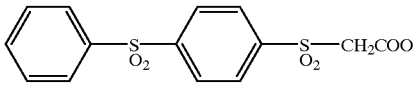

Compound 3

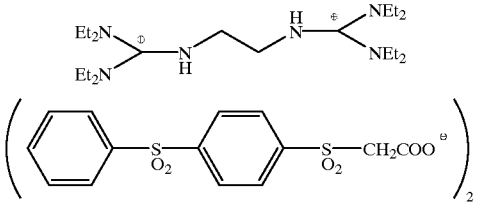

Coated Sample

The support used was a polyethylene terephthalate (PET) film of 175 μm thick tinted with a blue dyestuff. Onto one surface roar PET film, the emulsion layer coating solution and the surface protective layer coating solution, both prepared above, were concurrently applied in an overlapping manner to form an emulsion layer and a protective layer thereon so as to provide a silver coverage of 1.8 g/m$^2$ and a gelatin coverage of 1.8 g/m$^2$, respectively. After drying, the back layer coating solution was coated on the opposite surface of the film so as to provide an optical density of 0.7 at 650 nm. A series of coated samples, Nos. 319 to 335, were obtained in this way.

Photographic Test

The photographic material was exposed to light at an angle of 30° relative to a normal to the material surface by means of a 647-nm Kr laser sensitometer (maximum power 500 mW) and developed by heating at 120° C. for 20 seconds. The resulting image was measured for fog, maximum density (Dmax) and sensitivity by means of a densitometer. The sensitivity (S) is the reciprocal of a ratio of the exposure providing a density of fog (Dmin)+1.0, and is expressed in a relative value based on a sensitivity of 100 for coated sample No. 321.

Storage Stability Prior to Image Formation

Each coated sample was cut into sections of 30.5 cm×25.4 cm with round corners having an inner radius of 0.5 cm. Film sections were kept in an atmosphere of 25° C. and RH 50% for one day. Each sample sheet was placed in a moisture-proof bag, which was sealed and placed in a decorative box of 35.1 cm×26.9 cm×3.0 cm. In this condition, the sample was aged for 5 days at 50° C. (forced aging test). The aged sample was processed as in the photographic test and measured for fog, sensitivity (S) and maximum density (Dmax).

Image Stability Subsequent to Image Formation

The image formed samples were tested as in Example 8. The results are shown in Table 7.

It is evident from Table 7 that surprisingly, photographic elements using the compounds according to the invention maintain their photographic properties highly stable during the storage prior to the image formation process. Furthermore, quite unexpectedly, due to the combined use of the compounds according to the invention, the photographic elements are significantly improved in image retention subsequent to image formation. The performance as an image forming element is significantly improved. Among the compounds according to the invention, compounds I-1-10 and I-1-16 are most effective.

Example 10

Solid Particle Dispersion of Inventive Compound

To 10 grams of compound I-1-4, I-1-5, I-1-10, I-1-14, I-1-16, I-1-44 or I-1-47 according to the invention were added 4 grams of hydroxypropyl methyl cellulose and 86 grams of water. They were thoroughly agitated to form a slurry, which was allowed to stand for 10 hours. The subsequent procedure was the same as in the preparation of the solid particle dispersion of the inventive compound I-1-10 in Example 9, obtaining a solid particle dispersion of the toner. The particle size was the same as in the solid particle dispersion of the inventive compound I-1-10.

Coated Sample

Coated samples were prepared by the same procedure as coated sample No. 325 in Example 9 except that the solid particle dispersion of compound I-1-4, I-1-5, I-1-10, I-1-14, I-1-16, I-1-44 or I-1-47 according to the invention was added to the emulsion surface protective layer coating solution in amounts per mol of the organic arid silver as shown in Table 8. When phthalazine was used, a coated sample was prepared as in Example 9.

The coated samples were tested as in Example 9, with the results shown in Table 8.

TABLE 7

| Coated | Toner | | Antifoggant | | Photographic properties | | | Storage stability prior to processing | | | Stability subsequent to |
|---|---|---|---|---|---|---|---|---|---|---|---|
| sample | Type | Amount (mol/mol Ag) | Type | Amount (mol/mol Ag) | Fog | S | Dmax | Fog | S | Dmax | image formation |
| 319* | phthalazine | 0.04 | — | — | 0.49 | 115 | 3.1 | 0.89 | — | 1.4 | X |
| 320* | phthalazine | 0.04 | Comparative antifoggant | 0.05 | 0.11 | 21 | 3.0 | 0.25 | — | 1.2 | X |
| 321* | phthalazine | 0.04 | II-2 | 0.05 | 0.07 | 100 | 3.1 | 0.09 | 25 | 1.5 | X |
| 322* | phthalazine | 0.08 | II-2 | 0.05 | 0.10 | 98 | 3.0 | 0.11 | 11 | 1.4 | X |
| 323 | I-1-2 | 0.04 | II-2 | 0.05 | 0.06 | 98 | 3.0 | 0.07 | 100 | 2.8 | Δ |
| 324 | I-1-2 | 0.08 | II-2 | 0.05 | 0.07 | 105 | 3.0 | 0.09 | 102 | 2.8 | Δ |
| 325 | I-1-10 | 0.04 | II-2 | 0.05 | 0.06 | 103 | 3.4 | 0.07 | 106 | 3.2 | ○ |
| 326 | I-1-10 | 0.08 | II-2 | 0.05 | 0.07 | 105 | 3.3 | 0.07 | 108 | 3.2 | ◎ |
| 327 | I-1-14 | 0.04 | II-2 | 0.05 | 0.06 | 98 | 3.2 | 0.08 | 99 | 3.0 | Δ |
| 328 | I-1-14 | 0.08 | II-2 | 0.05 | 0.07 | 103 | 3.2 | 0.10 | 102 | 3.0 | ○ |
| 329 | I-1-16 | 0.04 | II-2 | 0.05 | 0.06 | 101 | 3.4 | 0.06 | 103 | 3.3 | ○ |
| 330 | I-1-16 | 0.08 | II-2 | 0.05 | 0.07 | 102 | 3.4 | 0.07 | 105 | 3.3 | ◎ |
| 331 | I-1-16 | 0.04 | II-2 | 0.025 | 0.09 | 123 | 3.3 | 0.10 | 121 | 3.2 | ◎ |
| 332 | I-1-16 | 0.04 | II-2 | 0.10 | 0.04 | 92 | 3.3 | 0.05 | 93 | 3.3 | ◎ |
| 333 | I-1-16 | 0.04 | II-3 | 0.05 | 0.07 | 110 | 3.3 | 0.07 | 106 | 3.4 | ◎ |
| 334* | I-1-16 | 0.04 | Comparative antifoggant | 0.05 | 0.11 | 36 | 3.3 | 0.24 | 24 | 3.3 | ◎ |
| 335 | I-1-16 | 0.04 | II-24 | 0.05 | 0.07 | 102 | 3.2 | 0.07 | 105 | 3.4 | ◎ |

*comparison

TABLE 8

| Coated sample | Toner Type | Toner Amount (mol/mol Ag) | Antifoggant Type | Antifoggant Amount (mol/mol Ag) | Photographic properties Fog | Photographic properties S | Photographic properties Dmax | Storage stability prior to processing Fog | Storage stability prior to processing S | Storage stability prior to processing Dmax | Stability subsequent to image formation |
|---|---|---|---|---|---|---|---|---|---|---|---|
| 336* | phthalazine | 0.06 | — | — | 0.68 | 123 | 3.3 | 0.89 | — | 1.2 | X |
| 337* | phthalazine | 0.06 | Comparative antifoggant | 0.04 | 0.11 | 41 | 3.0 | 0.33 | — | 1.1 | X |
| 338* | phthalazine | 0.06 | II-2 | 0.04 | 0.08 | 100 | 3.1 | 0.11 | 35 | 1.3 | X |
| 339* | I-1-4 | 0.06 | — | — | 0.76 | 136 | 3.5 | 1.95 | 7 | 3.0 | Δ |
| 340* | I-1-4 | 0.06 | Comparative antifoggant | 0.04 | 0.10 | 50 | 3.0 | 0.28 | 43 | 2.9 | Δ |
| 341 | I-1-4 | 0.06 | II-2 | 0.04 | 0.08 | 102 | 3.1 | 0.10 | 100 | 3.0 | ○ |
| 342 | I-1-5 | 0.06 | II-2 | 0.04 | 0.09 | 101 | 3.1 | 0.10 | 99 | 3.0 | ○ |
| 343 | I-1-10 | 0.06 | II-2 | 0.04 | 0.08 | 106 | 3.4 | 0.09 | 105 | 3.3 | ◎ |
| 344 | I-1-14 | 0.06 | II-2 | 0.04 | 0.09 | 103 | 3.2 | 0.09 | 103 | 3.0 | ○ |
| 345 | I-1-16 | 0.06 | II-2 | 0.04 | 0.08 | 106 | 3.4 | 0.09 | 106 | 3.3 | ◎ |
| 346 | I-1-44 | 0.06 | II-2 | 0.04 | 0.09 | 101 | 3.0 | 0.11 | 99 | 2.8 | ○ |
| 347 | I-1-47 | 0.06 | II-2 | 0.04 | 0.09 | 100 | 3.0 | 0.11 | 98 | 2.8 | ○ |

*comparison

The benefits of the invention are evident from Table 8.

Example 11

Silver halide grains C were prepared by the same procedure as the preparation of silver halide grains B in Example 9 except that Sensitizing Dyes E and F were used instead of Sensitizing Dyes C and D. Silver halide grains C were used instead of silver halide grains B. Instead of the sensitometer used in the examination of photographic properties in Example 8, a laser sensitometer equipped with a 820-nm diode was used for examining photographic properties, normal aging stability and image aging stability. Except for these, examination was made as in Example 9. It was found that the photographic properties of aged samples were significantly improved and the image areas were maintained significantly stable against aging.

Example 12

A coated sample was prepared as in Example 1 except that the surface protective layer coating solution was prepared using 0.37 g of phthalic acid instead of 0.4 g of 4-methylphthalic acid. This sample was examined for photographic properties as in Example 1, finding equivalent results to Example 1.

Example 13

Coated samples were prepared as in Example 2 except that the toner used in Example 2 was replaced by Exemplary Compounds I-4, I-9 or I-26 and that the surface protective layer coating solution was prepared using 60 mg of phthalic acid instead of 65 mg of 4-methylphthalic acid. These samples were examined for photographic properties as in Example 2, finding equivalent results to Example 2.

Sensitizing Dye E

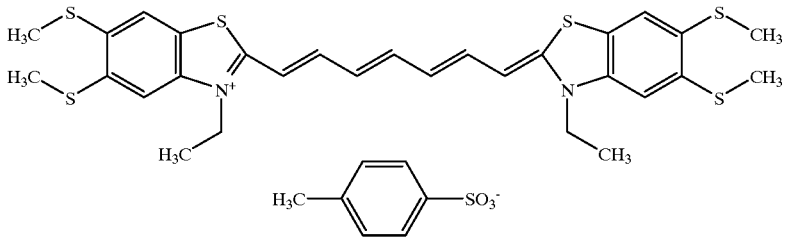

Sensitizing Dye F

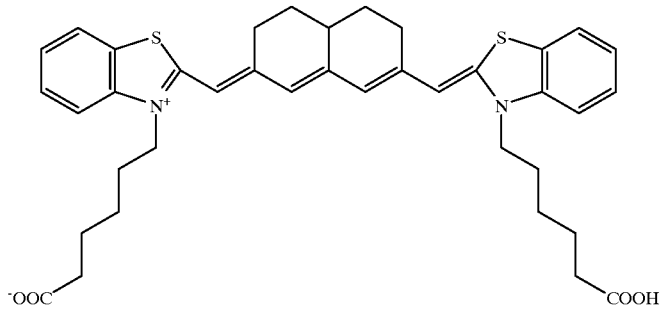

Example 14

A coated sample was prepared as in Example 3 except that the surface protective layer coating solution was prepared using 60 mg of phthalic acid instead of 65 mg of 4-methylphthalic acid. This sample was examined for photographic properties as in Example 3, finding equivalent results to Example 3.

Owing to the combined use of the compounds of formulae (I-1) and (III), image recording elements are improved in fog, photographic properties, maintenance of photographic properties during storage, and image retention during storage.

Japanese Patent Application Nos. 149249/1997, 164990/1997 and 164992/1997 are incorporated herein by reference.

Reasonable modifications and variations are possible from the foregoing disclosure without departing from either the spirit or scope of the present invention as defined by the claims.

What is claimed is:

1. A thermographic or photothermographic image recording element comprising (a) a reducible silver salt, (b) a reducing agent, (c) a binder, (d) a compound of formula (I-a):

(I-a)

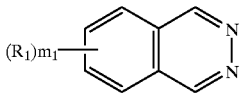

wherein $R_1$ is an alkyl, aryl, alkoxy, aryloxy, halogen, cyano or nitro group and is attached to the benzene ring in formula (I-a), and $m_1$ is an integer of 1 to 4, with the proviso that when $m_1 \geqq 2$, a plurality of $R_1$ groups may be the same or different, and a plurality of $R_1$ groups may form an aromatic ring or a heterocyclic ring, and (e) an organic acid compound of formula (II):

(II)

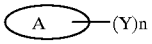

wherein A represents an n-valent aromatic ring group which is a monocyclic or fused ring, Y represents —COOH, $—SO_2H$ or $—SO_3H$, and n is equal to 1 or 2.

2. The image recording element of claim 1 further comprising a photosensitive silver halide as a photocatalyst.

3. The image recording element of claim 1 wherein the compound of formula (II) is a compound of formula (II-a):

(II-a)

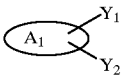

wherein $A_1$ is a phenylene or naphthylene group, each of $Y_1$ and $Y_2$ is —COOH, $—SO_2H$ or $—SO_3H$, and $Y_1$ and $Y_2$ are attached to $A_1$ in the ortho or meta relationship.

4. The image recording element of claim 1 wherein the organic acid compound of formula (II) is a compound of the formula (II-b):

(II-b)

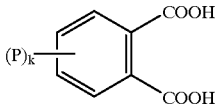

wherein P is an alkyl, aryl, alkoxy or nitro group, k is an integer of 1 to 4, with the proviso that when $k \geqq 2$, a plurality of P groups may be the same or different.

5. The image recording element of claim 1 wherein the binder originates front a polymer latex which is present in a coating solution for use in the preparation of said element.

6. The image recording element of claim 1 wherein the compound of formula (I-a) is added as a solid particle dispersion.

7. The image recording element of claim 1 further comprising at least one compound of formula (III):

(III)

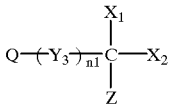

wherein Q is an alkyl, aryl or heterocyclic group, $X_1$ and $X_2$ are halogen atoms, Z is a hydrogen atom or electron attractive group, $Y_3$ is —C(=O)—, —SO— or —SO—, and n1 is equal to 0 or 1.

8. The image recording element of claim 1 wherein the compound of formula (I) is of the following formula (I-b), (I-c) or (I-d):

(I-b)

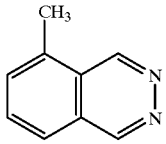

(I-c)

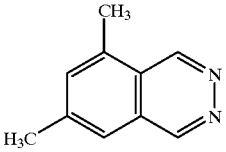

(I-d)

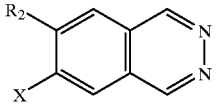

wherein $R_2$ is alkyl, and X is hydrogen or an alkyl, aryl, alkoxy, halorpen, cyano or nitro group.

9. The image recording element of claim 8, wherein $R_1$ is an alkyl group having 1 to 20 carbon atoms, an aryl group having 6 to 30 carbon atoms, an alkoxy group having 1 to 20 carbon atoms, an aryloxy having 6 to 20 carbon atoms, fluorine, chlroine, bromine or iodine.

10. The image recording element of claim 1 wherein the compound of formula (I) is added in an amount of $10^{-4}$ to 1 mol per mol of silver.

11. The image recording element of claim 1 wherein the compound of formula (II) is added in an amount of $10^{-4}$ to 1 mol per mol of silver.

12. The image recording element of claim 1 wherein the compound of formula (III) is added in an amount of $1\times10^{-6}$ to 0.5 mol per mol of silver.
13. The image recording element of claim 1 wherein the compound of formula (II) is selected from the group consisting of:
II-1
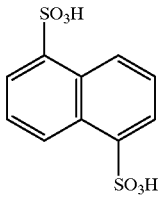
II-2
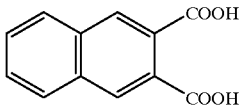
II-3
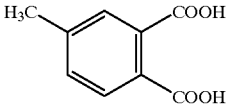
II-4
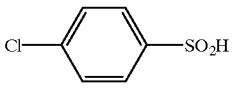
II-5
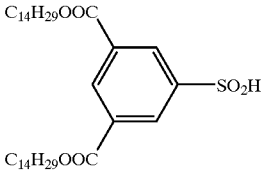
II-6
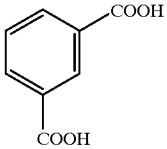
II-7
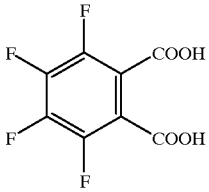
II-8
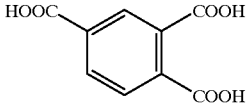
-continued
II-9
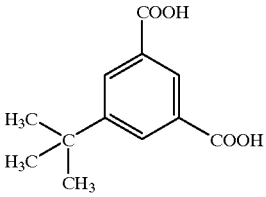
II-10
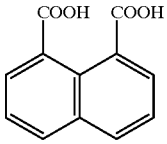
II-11
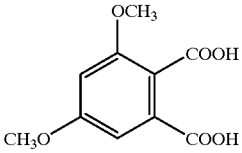
II-12
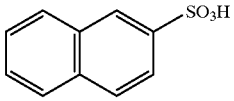
II-13
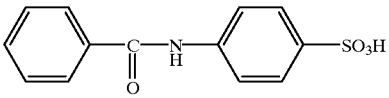
II-14
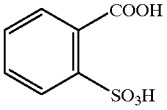
II-15
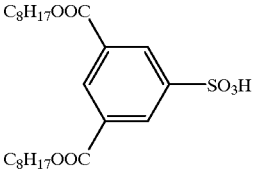
II-16
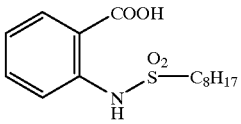
II-17
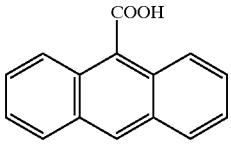
II-18
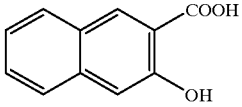

-continued
II-19
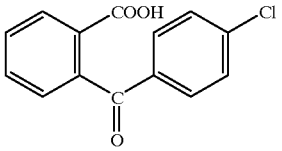
II-20
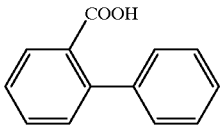
II-21
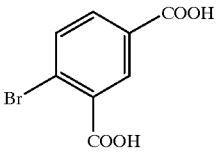
II-22
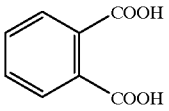
II-23
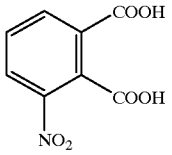
II-24
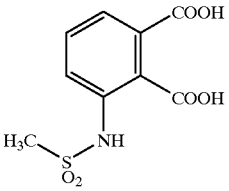
II-25
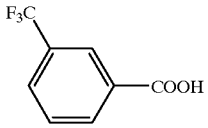
II-26
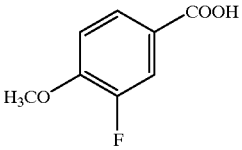
II-27
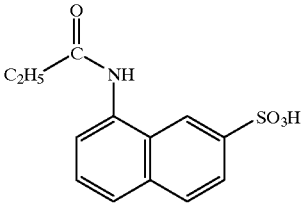
-continued
II-28
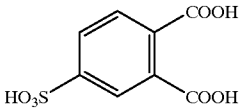
II-29
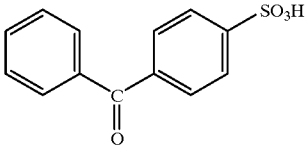
II-30
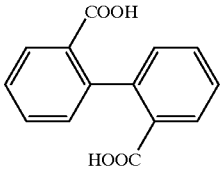
II-31
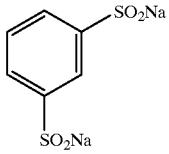
II-32
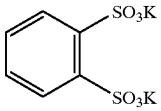
II-33
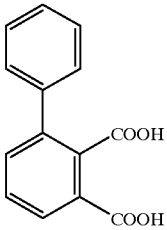
and
(II-c)
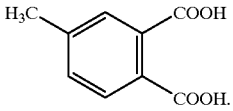
14. The image recording element of claim 1 wherein the compound of formula (III) is selected from the group consisting of:
III-1
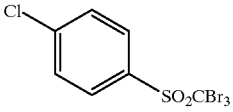

-continued
III-2
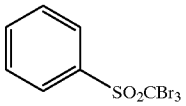
III-3
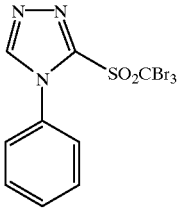
III-4
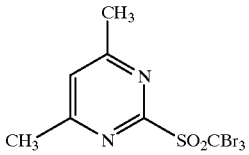
III-5
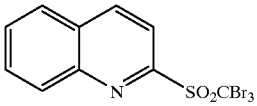
III-6
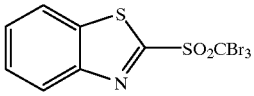
III-7
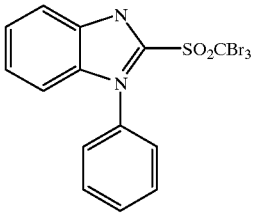
III-8
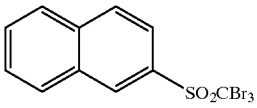
III-9
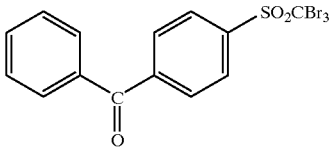
III-10
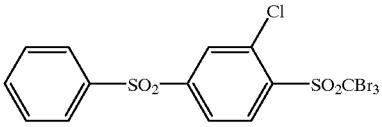
III-11
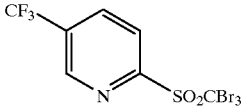
-continued
III-12
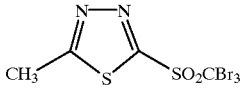
III-13
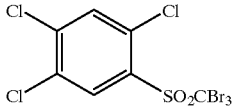
III-14
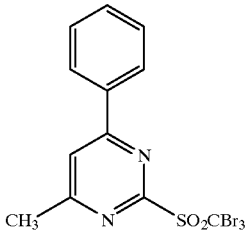
III-15
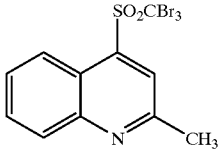
III-16
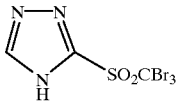
III-17
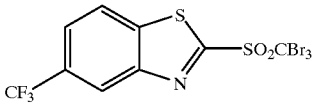
III-18
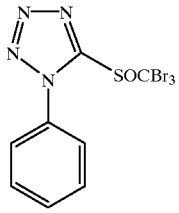
III-19
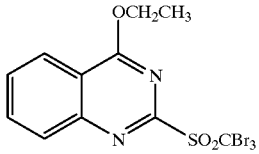
III-20
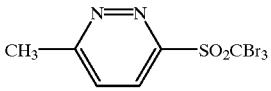
III-21
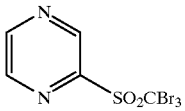

-continued

III-22

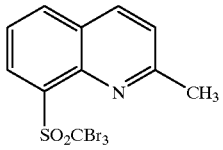

III-23

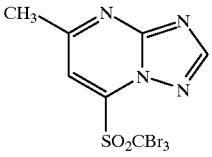

III-24

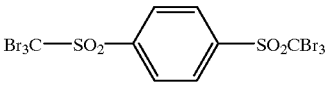

III-25

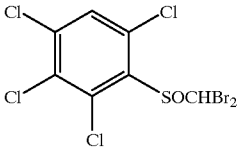

III-26

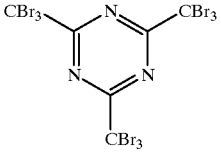

III-27

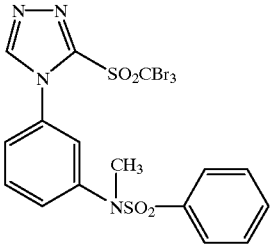

III-28

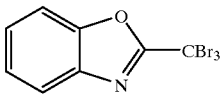

III-29

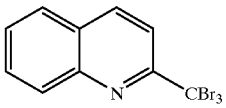

III-30

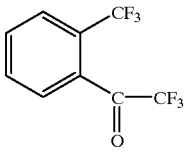

-continued

III-31

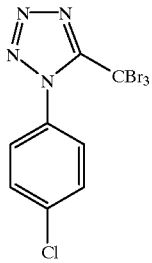

III-32

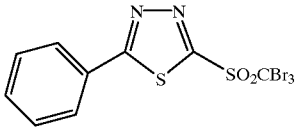

III-33

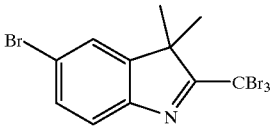

III-34

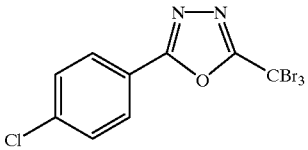

III-35

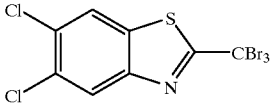

III-36

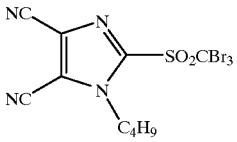

III-37

$CH_3(CH_2)_2CBr_2SO_2CBr_3$ and

III-38

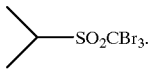

15. The image recording element of claim 1, wherein a polymer latex constitutes at least 50% by weight of the binder.

16. The image recording element of claim 1, wherein $R_1$ is an alkyl group having 1 to 20 carbon atoms, an aryl group having 6 to 30 carbon atoms, an alkoxy group having 1 to 20 carbon atoms, an aryloxy group having 6 to 20 carbon atoms, fluorine, chlorine, bromine or iodine.

17. A thermographic or photothermographic image recording element comprising (a) a reducible silver salt, (b) a reducing agent, (c) a binder, (d) a compound of formula (I-a):

(I-a)

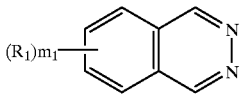

wherein $R_1$ is an alkyl, aryl, alkoxy, aryloxy, halogen, cyano or nitro group and is attached to the benzene ring in formula (I-a), and $m_1$ is an integer of 1 to 4, with the proviso that when $m_1 \geqq 2$, a plurality of $R_1$ groups may be the same or different, and (e) an organic acid compound of the general formula (II);

(II)

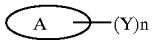

wherein A represents an n-valent monocyclic or fused ring aromatic ring group, Y represents —COOH, —$SO_2H$ or —$SO_3H$, and n is equal to 1 or 2.

* * * * *

UNITED STATES PATENT AND TRADEMARK OFFICE

CERTIFICATE OF CORRECTION

PATENT NO. : 6,146,822
DATED : November 14, 2000
INVENTOR(S) : Naoki Asanuma et al.

It is certified that error appears in the above-identified patent and that said Letters Patent is hereby corrected as shown below:

Column 88,
Line 29 (claim7, line 6), please change "-SO-" (second occurrence) to -- $-SO_2-$ --.

Signed and Sealed this

Second Day of October, 2001

*Attest:*

Nicholas P. Godici

NICHOLAS P. GODICI
*Acting Director of the United States Patent and Trademark Office*

*Attesting Officer*